US012653349B2

(12) United States Patent
Ciavarella et al.

(10) Patent No.: US 12,653,349 B2
(45) Date of Patent: Jun. 16, 2026

(54) DISPENSERS HAVING ANTI-LEAK AIR VENTS AND BUBBLE TRAPS

(71) Applicant: GOJO Industries, Inc., Akron, OH (US)

(72) Inventors: Nick E. Ciavarella, Seven Hills, OH (US); Stephen P. Casteel, Canal Fulton, OH (US); Ronald J. Hammond, Bentleyville, OH (US)

(73) Assignee: GOJO Industries, Inc., Akron, OH (US)

( * ) Notice: Subject to any disclaimer, the term of this patent is extended or adjusted under 35 U.S.C. 154(b) by 216 days.

(21) Appl. No.: 18/481,517

(22) Filed: Oct. 5, 2023

(65) Prior Publication Data

US 2024/0115082 A1 Apr. 11, 2024

Related U.S. Application Data

(60) Provisional application No. 63/414,663, filed on Oct. 10, 2022.

(51) Int. Cl.
*A47K 5/12* (2006.01)

(52) U.S. Cl.
CPC ..... *A47K 5/1202* (2013.01); *A47K 5/1217* (2013.01)

(58) Field of Classification Search
CPC ..... A47K 5/122; A47K 5/1217; A47K 5/12; A47K 5/1211
USPC ..... 222/52–69, 333
See application file for complete search history.

(56) References Cited

U.S. PATENT DOCUMENTS

| | | | | |
|---|---|---|---|---|
| 4,316,555 | A | 2/1982 | Smith | |
| 10,143,339 | B2 | 12/2018 | Ciavarella et al. | |
| 11,596,271 | B2 * | 3/2023 | McNulty | A47K 5/12 |
| 2008/0185398 | A1 * | 8/2008 | Yang | A47K 5/1217 222/52 |
| 2023/0255412 | A1 | 8/2023 | Ciavarella et al. | |
| 2023/0264210 | A1 | 8/2023 | Louis | |
| 2024/0016346 | A1 | 1/2024 | Buday et al. | |

* cited by examiner

*Primary Examiner* — David J Walczak
(74) *Attorney, Agent, or Firm* — Calfee, Halter & Griswold LLP

(57) ABSTRACT

An exemplary soap or sanitizing dispenser includes a housing, a permanent reservoir located within the housing, a pump in fluid communication with the permanent reservoir and a refill port. The refill port is configured to connect to a refill container. A refilling vent conduit extends upward from the permanent reservoir. The refill vent conduit extends above a maximum fill line of the refill unit and a vent valve is located proximate an upper end of the refill vent conduit.

20 Claims, 22 Drawing Sheets

DISPENSERS HAVING ANTI-LEAK AIR VENTS AND BUBBLE TRAPS

RELATED APPLICATIONS

The present application claims the benefits of and priority to U.S. Provisional Pat. App. No. 63/414,663 filed on Oct. 10, 2022, which is incorporated by reference herein in its entirety.

TECHNICAL FIELD

The present invention relates generally to dispensers and more particularly to dispensers having reservoirs that vent to atmosphere that have anti-leak air vents and/or bubble traps.

BACKGROUND OF THE INVENTION

Dispensers, such as, for example, soap and sanitizer dispensers, often run out of soap or sanitizer and need to be refilled. Dispensers, such as the one shown in U.S. Pat. No. 4,316,555, having a permanent reservoir that needs to be refilled periodically may have a vent to allow air in the permanent reservoir to escape. Such a vent is often messy as soap, and/or soap bubble flow out of the vent.

SUMMARY

Exemplary soap and sanitize dispensers are disclosed herein. An exemplary soap or sanitizing dispenser includes a housing, a permanent reservoir located within the housing, a pump in fluid communication with the permanent reservoir and a refill port. The refill port is configured to connect to a refill container. A refilling vent conduit extends upward from the permanent reservoir. The refill vent conduit extends above a maximum fill line of the refill unit and a vent valve is located proximate an upper end of the refill vent conduit.

Another exemplary soap or sanitizing dispenser includes a housing, a permanent reservoir located within the housing, a pump in fluid communication with the permanent reservoir and a refill port. The refill port is configured to connect to a refill container. A refilling vent extending upward from the permanent reservoir. The refill vent conduit extends above a maximum fill line of the refill unit and a bubble trap is located proximate an upper end of the refill vent conduit.

Another exemplary soap or sanitizing dispenser includes a housing, a permanent reservoir located within the housing, a pump in fluid communication with the permanent reservoir and a refill port. The refill port is configured to connect to a refill container. A refilling vent extends upward from the permanent reservoir. The refill vent conduit extends above a maximum fill line of the refill unit. A vent valve is located proximate an upper end of the refill vent conduit and a bubble trap located proximate an upper end of the refill vent conduit.

Another exemplary soap or sanitizing dispenser includes a housing, a processor, memory, a permanent reservoir located within the housing, a pump in fluid communication with the permanent reservoir, and a refill port. The refill port is configured to connect to a refill container. A refilling vent conduit extends upward. The exemplary dispenser includes an electronically controlled vent valve located proximate an upper end of the refill vent conduit.

BRIEF DESCRIPTION OF THE DRAWINGS

To further clarify various aspects of the present disclosure, a more particular description of inventive concepts will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale. Features and advantages of the present disclosure will be described and explained with additional specificity and detail through the use of the accompanying drawings in which.

DETAILED DESCRIPTION

The following description refers to the accompanying drawings, which illustrate specific aspects of the present disclosure.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1:
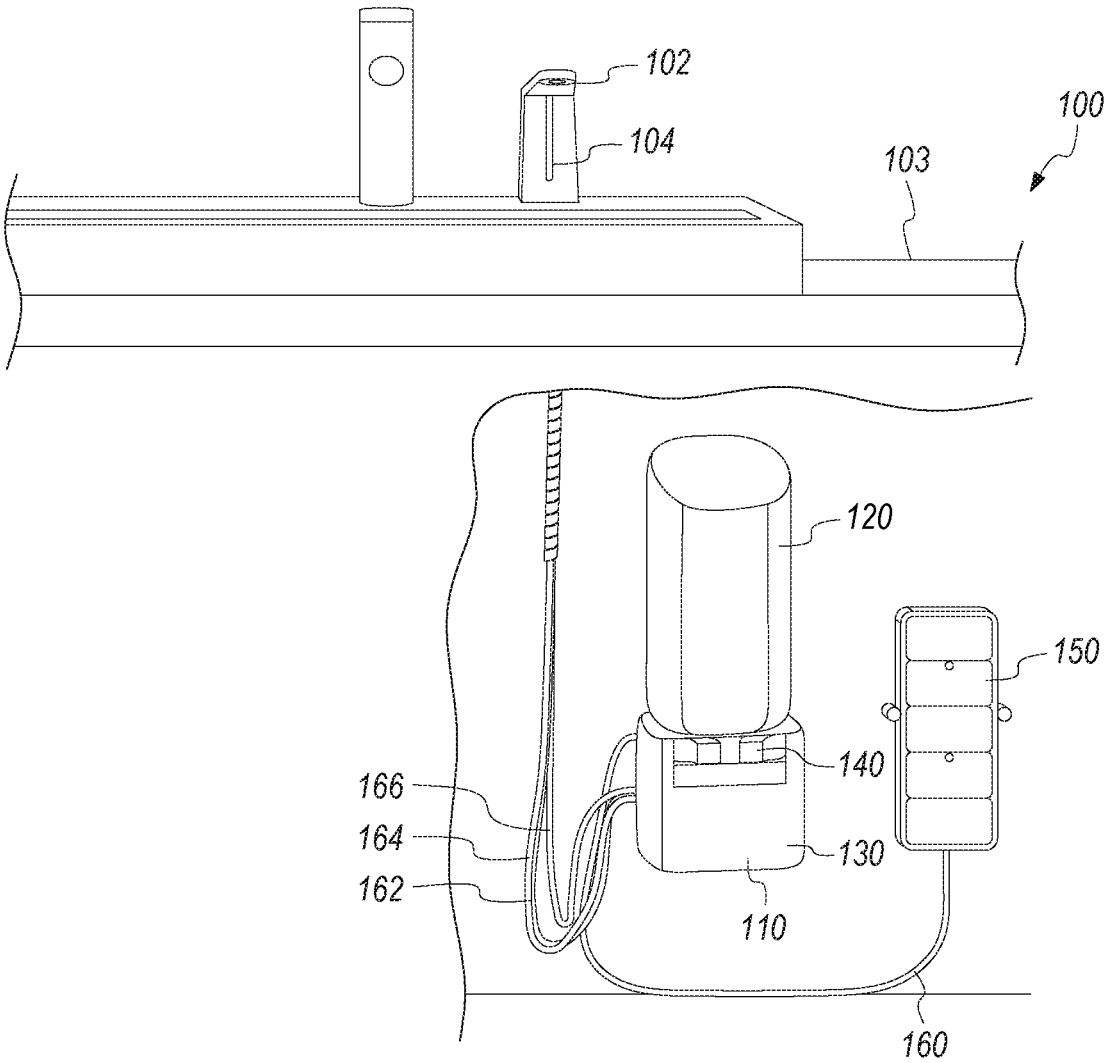
FIG. 1 is an exemplary soap or sanitizer dispenser system.
Figure 3:
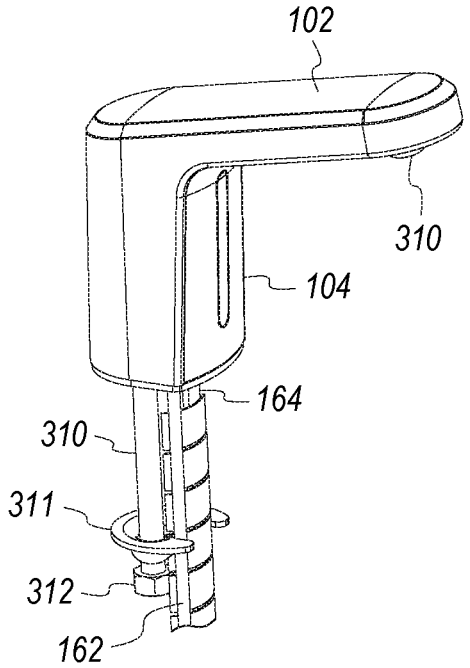
FIG. 3 is a perspective view of an exemplary dispenser spout.
Figure 2:
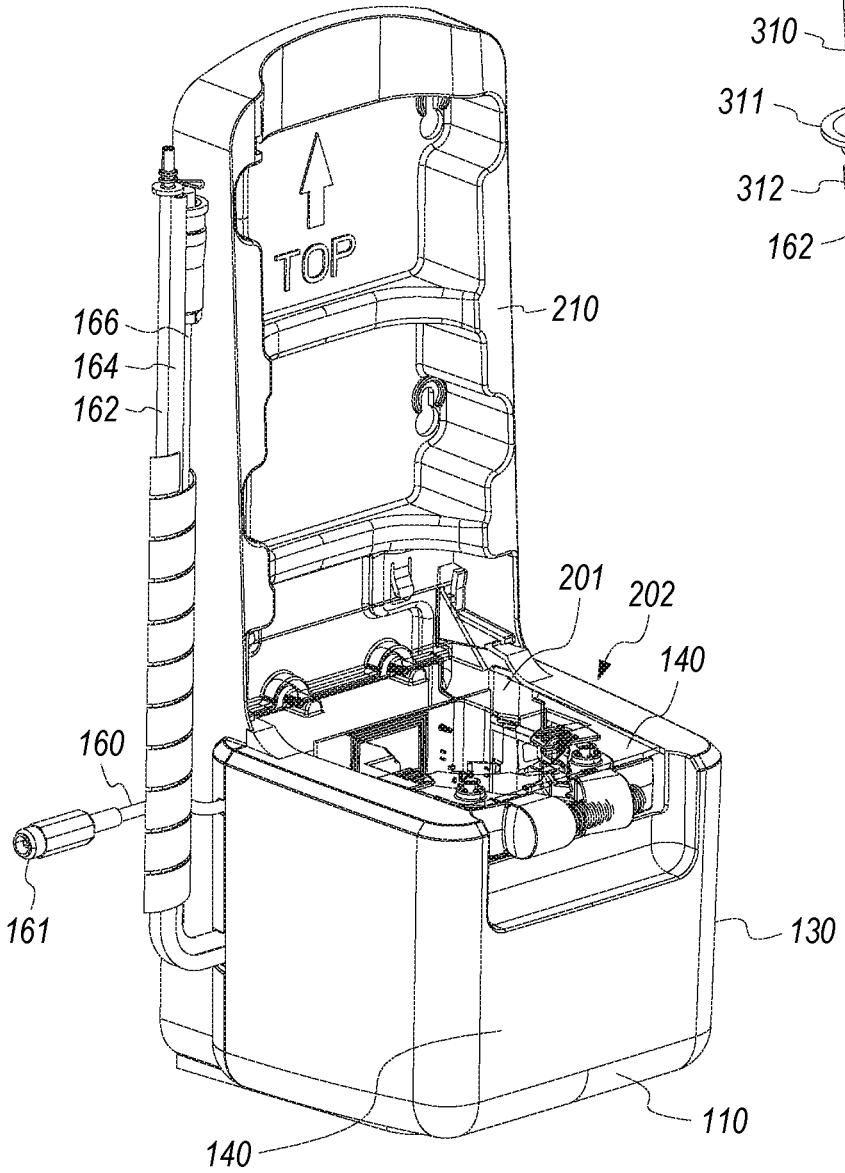
FIG. 2 is a prospective view of an exemplary dispenser base.

An exemplary soap or sanitizer dispenser system 100 is illustrated in FIG. 1. The exemplary dispenser system 100 is a counter-mount dispenser system. The inventive concepts described herein may be used in other dispenser systems, such as for example, table-top dispensers, wall-mounted dispensers, stand-mounted dispensers and the like. Dispenser system 100 includes a spout 102 mounted to a countertop 103. Dispenser system 100 is a touch-free dispenser system. The inventive concepts may be used in a manual system. Spout 102 includes an optional sensor 104. Sensor 104 detects the presence of a hand in the dispensing area and upon such detection, a processor (not shown) causes a dose of fluid to be dispensed to a user's hands. The optional sensor 104 is preferably an infrared (IR) sensor, but may be another type of dispenser, such as, for example, a capacitance sensor, an ultrasonic sensor, a heat detection sensor, or the like. An exemplary sensor 104 is shown and described in co-pending U.S. Provisional Pat. Application Ser. No. 63/388,371, titled Touch Free Dispensers Having Improved Hand Sensing, which is incorporated herein by reference in its entirety. Sensor 104 may be mounted remotely from the spout 102. As shown in FIG. 3, spout 102 includes a threaded rod 310, a u-shaped plate 311 and a nut 312 for mounting spout 102 to countertop 103.

Dispenser system 100 is a foam-at-a-distance dispenser. Liquid is pumped up to a mixing chamber (not shown) in spout 102 through conduit 164 and air is pumped up to the mixing chamber (not shown) through conduit 162. The air and liquid are mixed in the mixing chamber (not shown) and are dispensed out of outlet 310 in the form of a foam. Exemplary foam-at-a-distance spouts and mixing chambers are shown and described in co-pending U.S. Provisional Pat. Application Ser. No. 63/311,663 titled Remote Foam Generators and Foam At A Distance Dispenser Systems, U.S. Provisional Patent Application Ser. No. 63/311,225, titled Reduced Loss Of Prime Foam-At-A-Distance Dispenser Systems, which are incorporated herein by reference in their entirety. Electrical cable 166 provide power to sensor 104 and provides signals from sensor 104 to a processor (not shown) in dispenser base 130. Although dispenser 100 is a foam-at-a-distance dispenser, the inventive concepts may be used with a liquid dispenser, a foam near the pump dispenser, a counter mount dispenser, a wall mount dispenser or the like.

Dispenser system 100 is powered by a battery pack 150. Battery pack 150 may be one or more batteries. Dispenser system 100 may be powered by other means, such as, for example, solar power, focused energy power systems, 115 VAC systems with power converters, or the like. Power cable 160 extends from battery pack 150 to dispenser base 130. Dispenser base 130 has an optional back plane 210. Back plane 210 may be mounted to a back wall as shown in FIG. 1. Back plane 210 may be mounted to a side wall. Optionally, dispenser base 130 may be configured to sit on the floor below the counter. Dispenser base 130 may be attached to the floor. Power cable 160 may include one or more connectors 161. Connectors 161 may facilitate shipping. Connectors 161 may also make installation easier with the ability to add length to cable 160 without having to splice wires.

Base 130 has an optional shell 110. Shell 110 provides protection to the components located within dispenser base 130. Components located within base 130 include, for example, a processor (not shown), memory (not shown), one or more motors (not shown), one or more pumps (not shown). Exemplary pumps are shown and described in U.S. Pat. No. 10,143,339 which is incorporated herein by reference in its entirety. Additional components may also be included, such as, for example, an encoder for counting motor or pump revolutions to control dose size, or the like.

Dispenser system 100 includes a pump housing 201. Pump housing 201 includes a receptacle 202. In addition, pump housing 201 includes a pair of latching arms 140. Although a pair of latching arms 140 are shown and described, one latching arm 140 may be used. Receptacle 202 receives the neck 403 (FIG. 4) of container 402.

Figure 4:
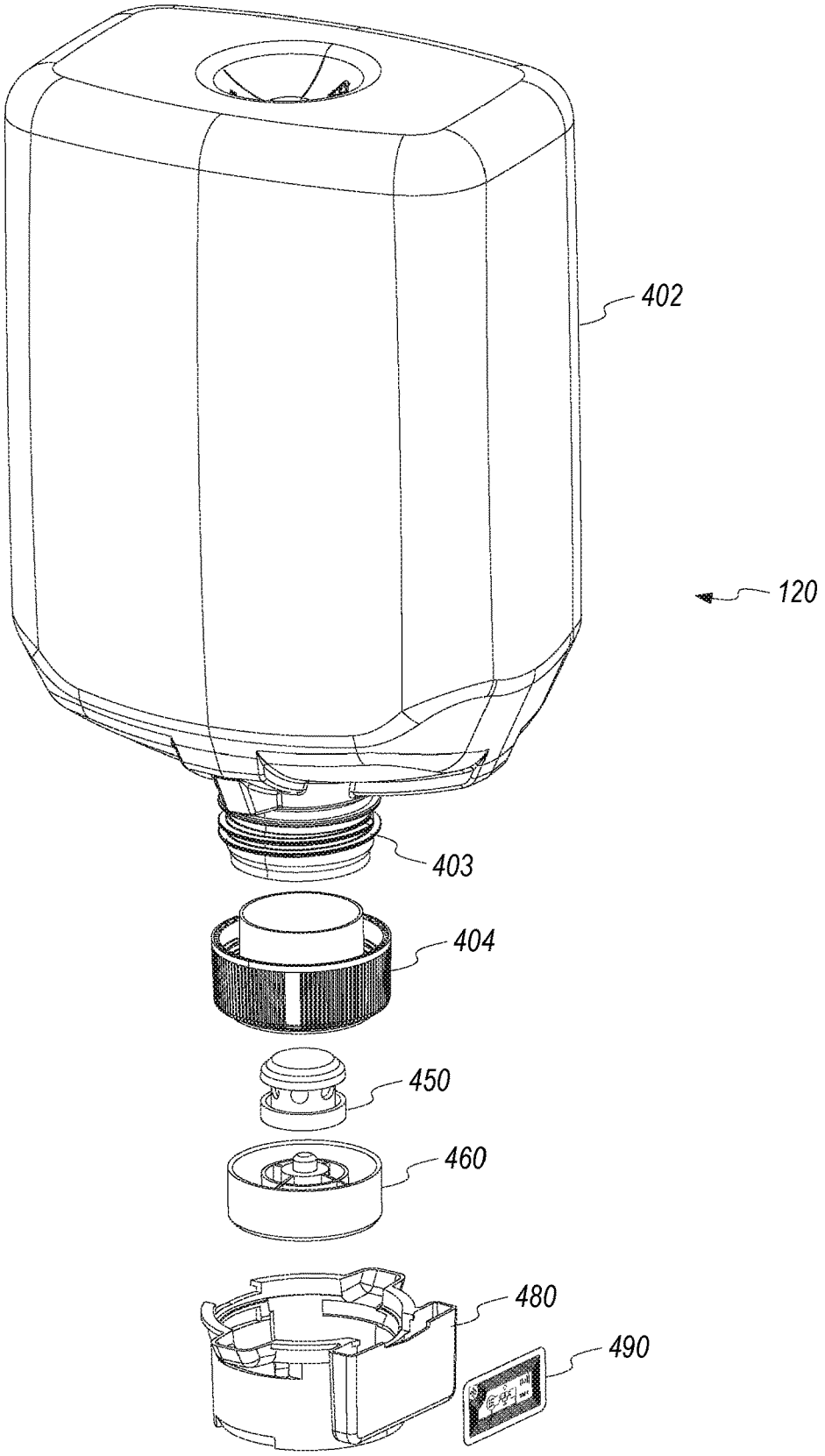
FIG. 4 is an exploded view of an exemplary refill unit for a soap or sanitizer dispenser system.

FIG. 4 illustrates an exemplary refill unit 120 that may be used in dispenser system 100. Refill unit 120 includes a container 402. Container 402 includes a neck 403, a closure 404, a valve 450 and an optional dust cap 460. Refill unit 120 may also include a key collar 480. Valve 450 is a normally closed valve that may be opened up to allow liquid to flow out of container 402. Valve 450 may also allow air up into container 402. Optional valve cover 460 may be included to keep valve 450 clean and from dust and debris prior to the valve cover 460 being removed and the refill unit 120 being installed in the dispenser. In addition, the valve cover 460 may be included aid in valve 450 retention during distribution. The valve cover 460 can be a plastic injection molded component, adhesive peel seal, or induction heat seal. Closure 404 is connected to neck 403. Closure 404 may be connected to neck 403 by any means, such as, for example, a threaded connection, a welded connection, a glued connection, a snap-fit connection, a friction fit connection, or the like. Key collar 480 fits over closure 404 and includes an optional key 490. Optional key 490 is a memory device, such as, for example, and RFID. Optional key 490 may be a read-only key or a read-write key. Optional key 490 may contain information relating to the refill unit, such as, for example, volume of refill, volume remaining in refill, type of fluid in refill, manufacturing date, expiration date, dose size, and the like.

Figure 5:
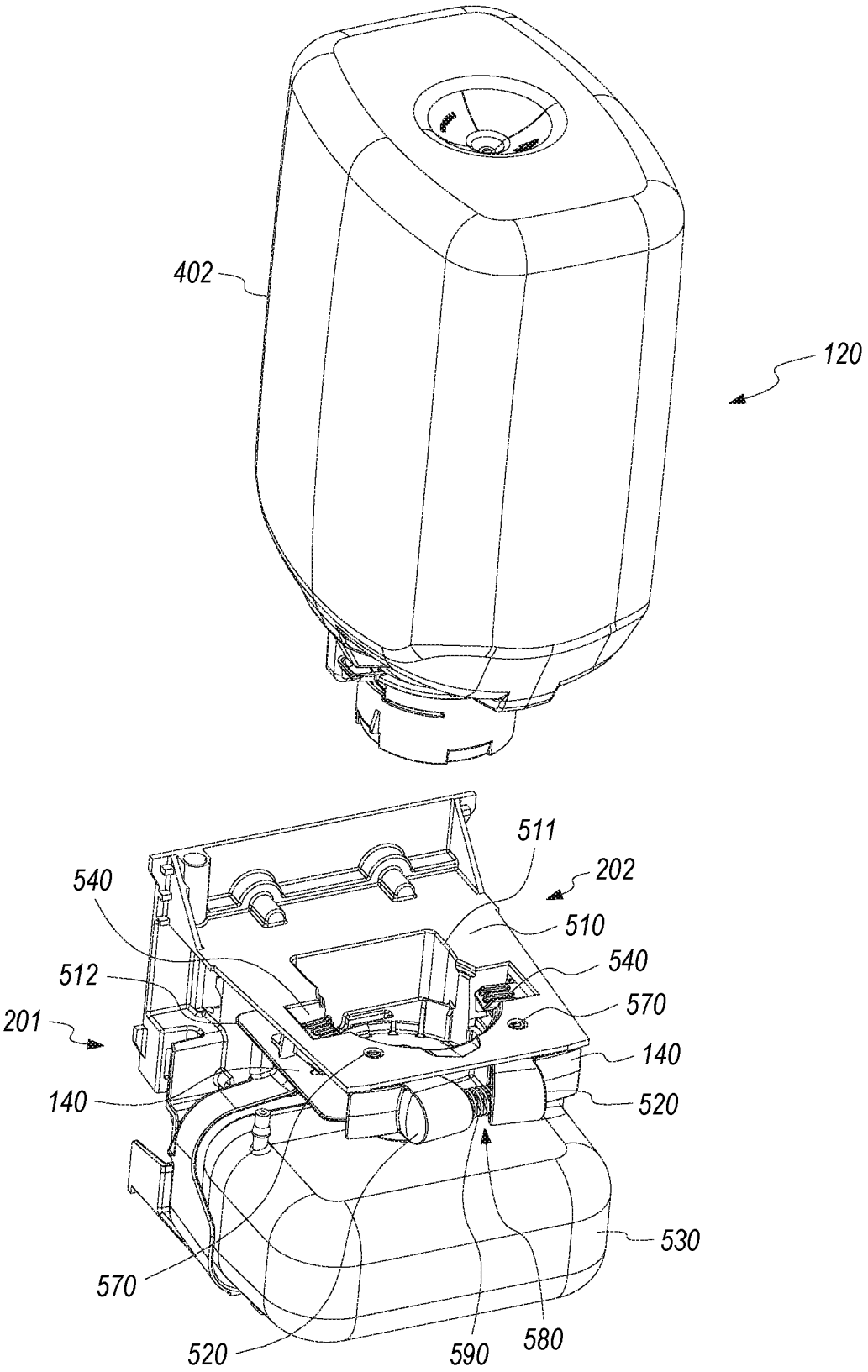
FIG. 5 is a perspective view of the exemplary refill unit of FIG. 4 prior to insertion into a pump house receptacle.

FIG. 5 illustrates pump housing 201 with shell 110 and backplane 210 of dispenser base 130 removed (other components have been removed for clarity). Refill unit 120 is removed from pump housing 201. A reservoir 530 is located in pump housing 201. Reservoir 530 receives fluid from container 402, and the fluid from reservoir 530 is pumped to the spout 102 when the dispenser system 100 is dispensing.

Pump housing 201 includes an upper plate 511. Upper plate 511 has an opening 511. A pair of latching arms 140 are secured to pump housing 201. Although a pair of latching arms are shown, the inventive concepts may utilize only one latching arm. Latching arms 140 include a latch 540. Latching arms 140 are shown in an unlatched position 580.

Latch 540 may have a sloped or ramped upper surface that slopes downward toward the end of the latch 540. If the latching arms 140 are in the latched position when a refill unit 120 is inserted into the dispenser 130, the downward sloped surface causes the latch arms 140 to be pushed outward so that the refill unit 120 may be inserted into the dispenser even though the latch arms 140 are not locked or retained in their unlatched position 580.

A biasing member 590 biases the latching arms 140 toward the latched position. The biasing member 590 may be, for example, a spring, an elastomeric member, a rubber member, or the like. The spring may be a metal spring or a plastic spring.

Latching arms 140 pivot with respect to the pump housing, i.e. the pump arms 140 have a pivot point. Pump housing 201 includes an optional lower plate 512. Upper plate 511 includes apertures 570. Apertures 570 are circular in shape. Lower plate includes apertures (not shown) directly below apertures 570. Latching arms 140 include optional cylindrical projection 710 and optional cylindrical projection 710A, which fit into apertures 570 and the apertures (not shown) in lower plate 512. In some embodiments, latching arms 140 move inward and outward in a linear path, rather than an arcuate path. In such applications, aperture 570 may be, for example, an elongated slots. These applications may require additional biasing members.

Figure 6:
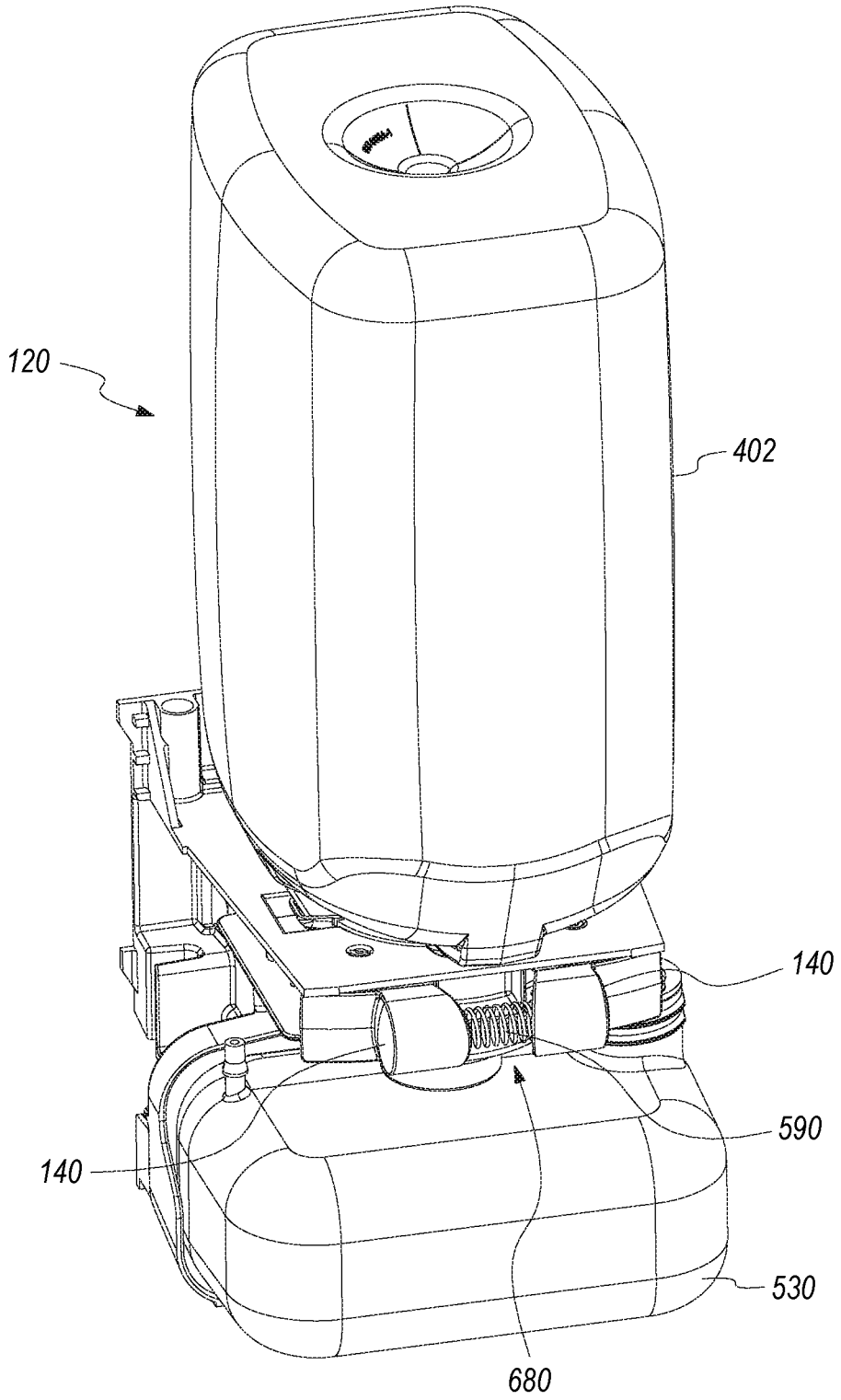
FIG. 6 is a perspective view of the exemplary refill unit of FIG. 4 inserted into the pump house receptacle of FIG. 5.

Latching arms 140 include engagement surfaces 520. Engagement surfaces 520 are engaged by a user to move the latching arms 140 from the latched position 680 (FIG. 6) to the unlatched position 580.

Figure 7A:
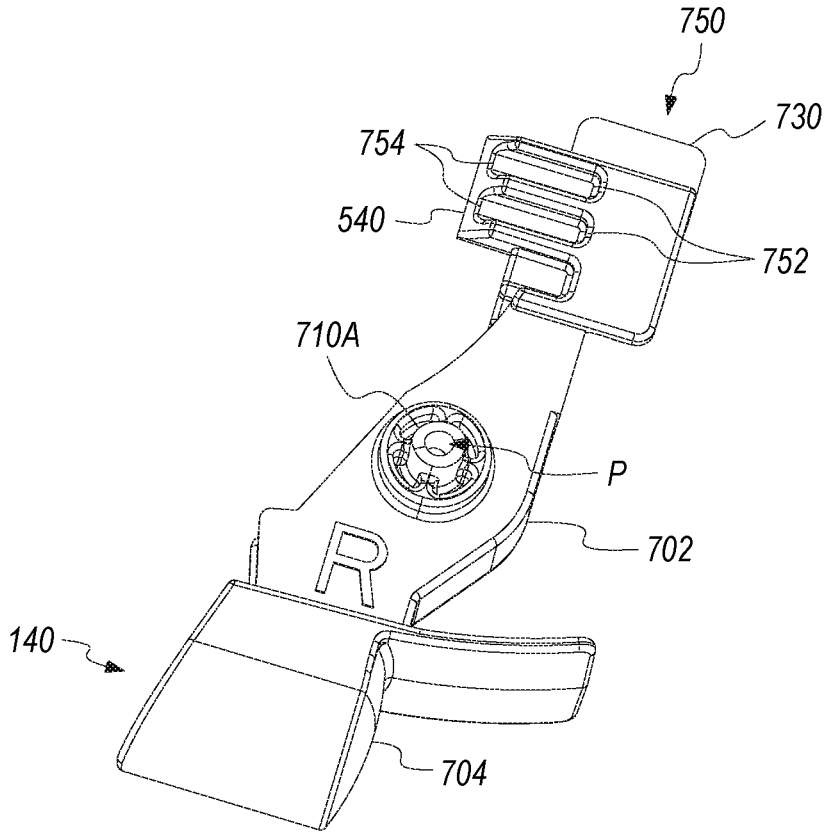
FIGS. 7 and 7A are prospective views of an exemplary latching arm.
Figure 7:
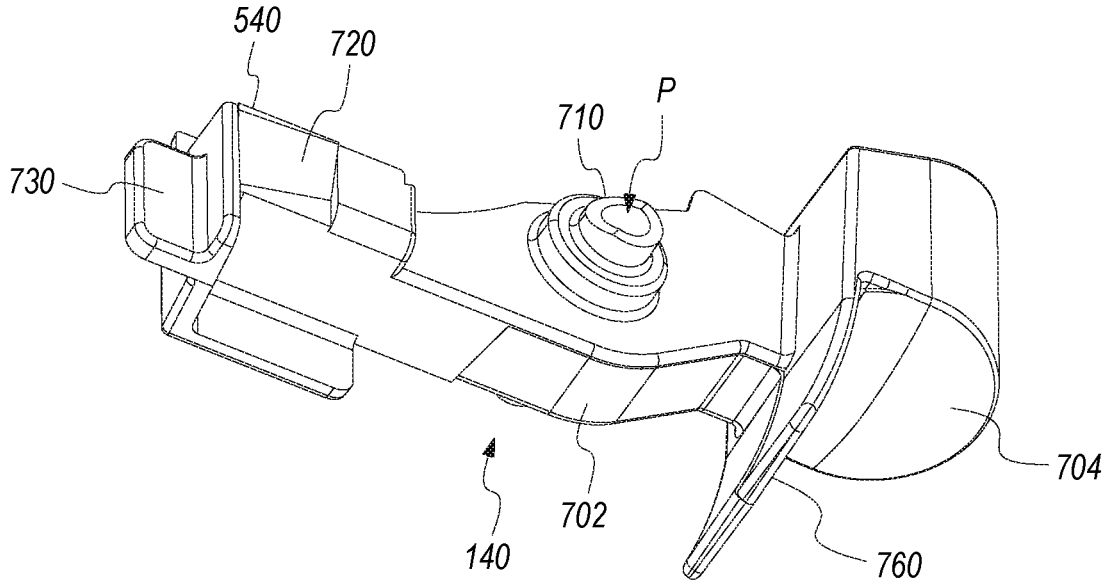
Figure 8:
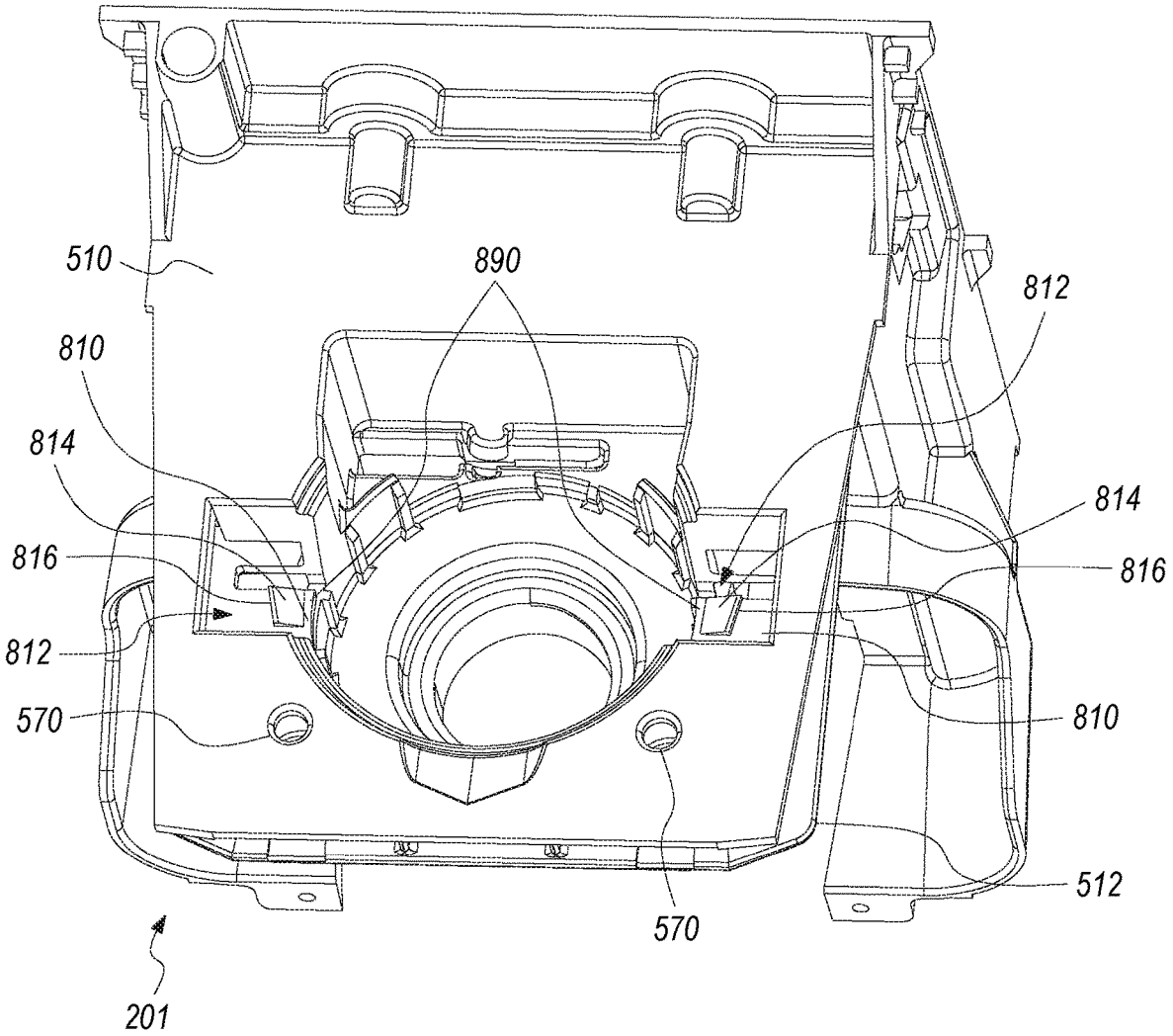
FIG. 8 is a top prospective view of the pump house receptacle of FIG. 5.

FIG. 7 is a prospective top view of a latching arm 140 and FIG. 7A is a prospective bottom view of the latching arm 140. Latching arm 140 has a body 702. The illustrated latching arm 140 includes a cylindrical projection 710 and 710A located at pivot point P. Cylindrical projections 710 and 710A may be replaced with one or more cylindrical openings and cylindrical projections may be located on the upper plate 510 and lower plate 510. Latching arm 140 and upper plate 510 and lower plate 512 may each have cylindrical openings and a pin (not shown) may be used to attach latching arm 140 to upper plate 510 at the pivot point P. Body 702 includes an optional finger guide 760. Body 702 incudes an optional guide plate 730. Optional guide plate 730 is configured to ride along a projection (not shown) on one of the upper plate 510 and the lower plate 512 to prevent latching arm 140 from upward or downward movement.

Latching arm 140 includes an engagement member 750. Engagement member 750 includes an arm engagement surface 752. In addition, engagement member 750 includes a surface 754. Surface 754 may optional be a sloped or ramped surface. Engagement member may be a projection. Engagement member may have numerous shapes and sizes provided engagement member 750 includes an arm engagement surface 752. Arm engagement surface 752 may be flat vertical surface. Arm engagement surface 752 may have an angled surface. The angled surface may form an "undercut". An undercut may aid in retaining the latching arm 140 in the unlatched position 680. Arm engagement surface 752 may have an angled surface with a rounded top portion.

Lower plate 512 includes retaining members 812. Retaining members 812 have a retaining member engagement surface 816. Retaining member engagement surface 816 may be flat vertical surface. Retaining member engagement surface 816 may have an angled surface. The angled surface may form an "undercut". An undercut on one or both of retaining member engagement surface 816 and arm engagement surface 752 may aid in retaining latching arm 140 in the unlatched position. Retaining members 812 may have a sloped or ramped surface 814.

Retaining members 812 are located on a flexible tab 810. Flexible tabs 810 is a resilient member that may be deflected and is biased toward its undeflected position. Flexible tabs 810 may be tabs cut into a portion of lower plate 512. Flexible tabs 810 include a release engagement surface 890. Release engagement surface 890 may be located at an outer end of the flexible tab 810. Release engagement surface 890 may be engaged by contact surface 912 of release member 910 as described below to deflect flexible tab 810.

When latching arms 140 are moved from their latched position 580 to their unlatched position 680, engagement surface 752, which may be a sloped or ramped surface, is engaged by surface 752 of arm engagement member. The flexible tabs 810 deflect downward. When arm engagement surface 752 passes the end of surface 814, the flexible tabs 810 move upward so that arm engagement surface 752 contacts retaining member engagement surface 816. Thus, latching arms 140 are retained or locked in an unlatched position. The user can release engagement arms 140 and engagement arms 140 remain locked in an unlatched position.

Figure 9:
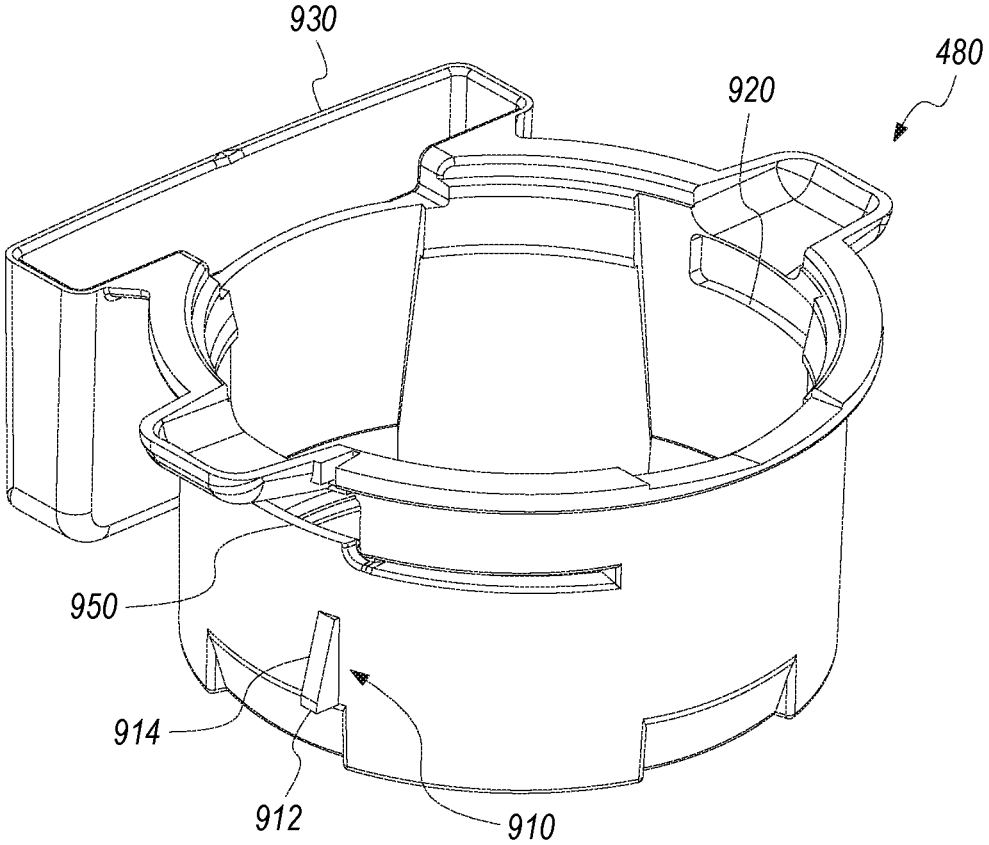
FIG. 9 is a prospective view of an exemplary key collar.

FIG. 9 is a prospective view of an exemplary optional key collar 480. Optional key collar 480 snap fits over closure 404. Key collar 480 includes a pocket 930 for receiving a key (not shown). In addition, this exemplary key collar 480 includes a pair of slots 950. Slots 950 are configured so that latch 540 passes through slots 950 which allows the latches 540 to latch onto the closure 408 to retain the refill unit 120 in place. In addition, if the key collar 480 is rigidly secured to closure 408, latches 540 may latch onto slots 950.

Located on key collar 480 is a pair of latch release members 910. Latch release members 910 are on key collar 480, however, latch release members 910 may be located on any part of the refill unit 120, such as, for example, on closure 404. Latch release members 910 include a release member contact surface 914. Optionally, latch release members 910 include a sloped surface 914.

When refill unit 120 is lowered into receptacle 202, latch release member 910 contacts release engagement surface 890 of flexible tab 810. The engagement causes flexible tab 810 to deflect downward. As flexible tab 810 moves downward, latching arm retaining surface 752 disengage from retaining member engagement surface 816. Biasing member 590 causes the latching arms 140 to move toward the latching position 680.

Figure 10:
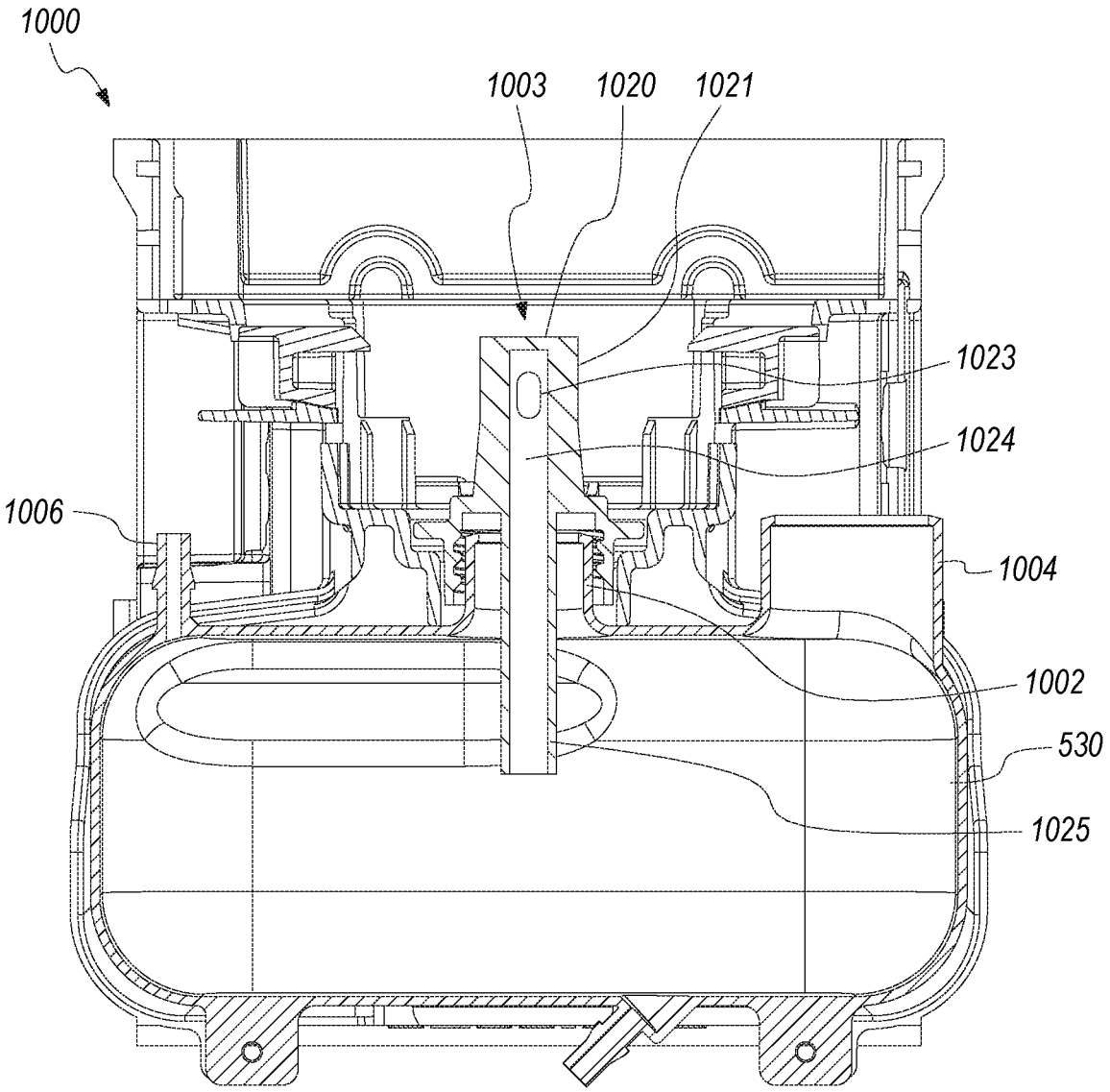
FIG. 10 is a cross-sectional view of the exemplary pump house and reservoir.

FIG. 10 is a cross-section of a portion 1000 of a dispenser base 130. Reservoir 530 is a sealed reservoir and includes a neck 1002. Attached to neck 1002 is a valve post 1003. Valve post 1003 engages valve 450 and opens valve 450 when refill unit 120 is inserted into dispenser base 130. Valve post 1003 includes a valve contact surface 1020. Valve post 1003 includes one or more apertures 1023 from an outside surface 1021 of valve post 1003 to an interior hollow passage 1024. A tube 1025 extends downward into reservoir 530. Optionally, valve post 1003 includes one or more passages that allow air in reservoir 530 to flow up into container 402 as liquid is drawn out of container 402.

Reservoir 530 also includes a liquid outlet opening (not shown), which is in fluid communication with a pump (not shown).

Reservoir 530 includes an optional opening 1004. Optional opening 1004 may be used to attach a float to the reservoir 530. A float (not shown) may be used to determine a level of fluid in the reservoir 530.

Reservoir 530 includes an optional opening 1006. Opening 1006 may be used to vent reservoir 530 when fluid is added to reservoir 530. In addition, reservoir 530 includes a fluid outlet (not shown). No other openings are formed in reservoir 530.

Figure 11:
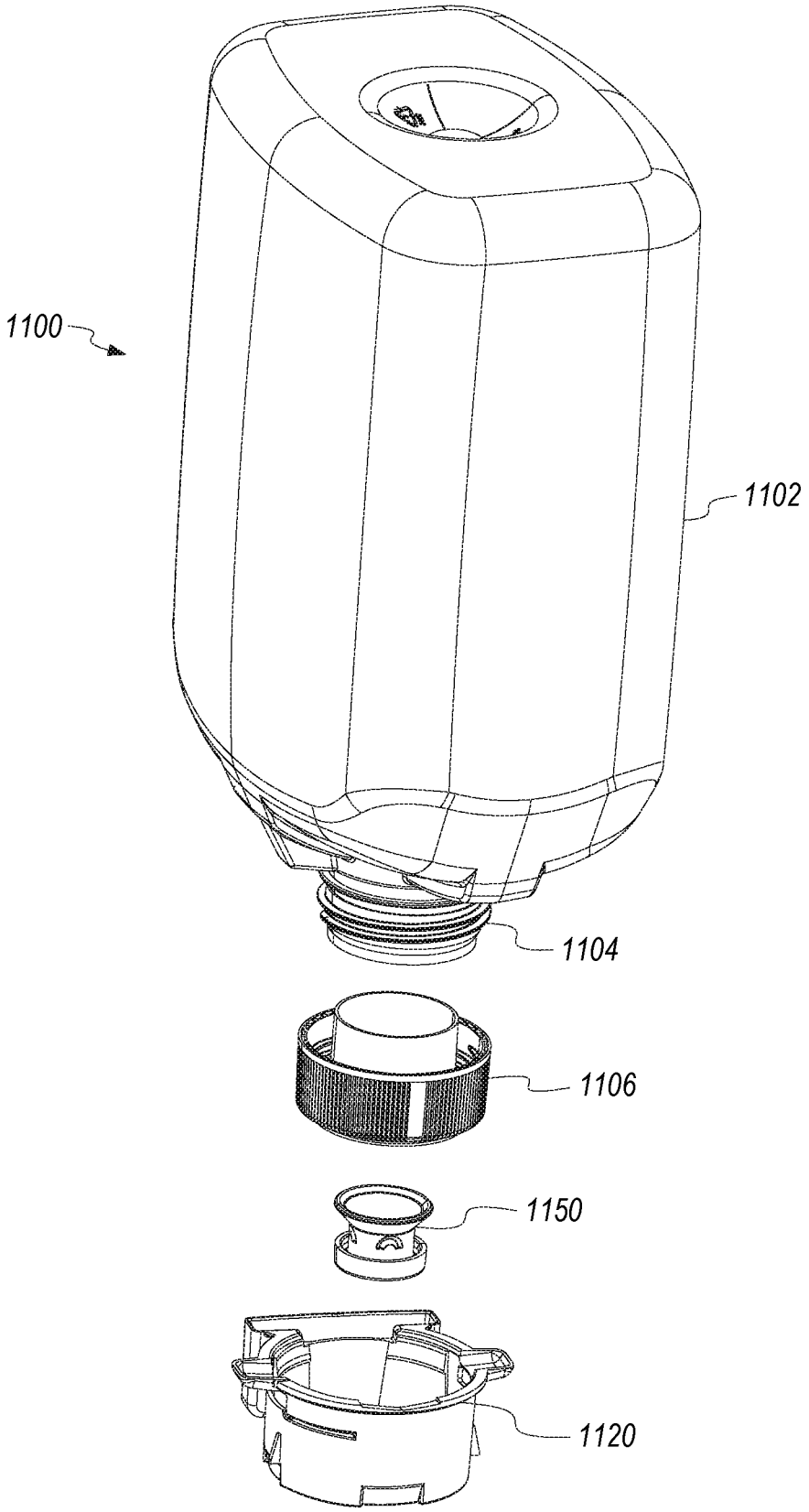
FIG. 11 is an exploded view of an exemplary refill unit.

FIG. 11 is an exploded view of an exemplary refill unit 1100. Refill unit 1100 includes a container 1102, a closure 1106, a stretch-valve 1150 and an optional key collar 1120. Key collar 1120 is similar to key collar 480 and is not redescribed herein. Closure 1106 is secured to the neck 1104 of container 1102. Closure 1106 may be connected to neck 1104 by, for example, a threaded connection (as shown), a snap fit connection, a friction fit connection, a welded connection or the like.

Figure 12:
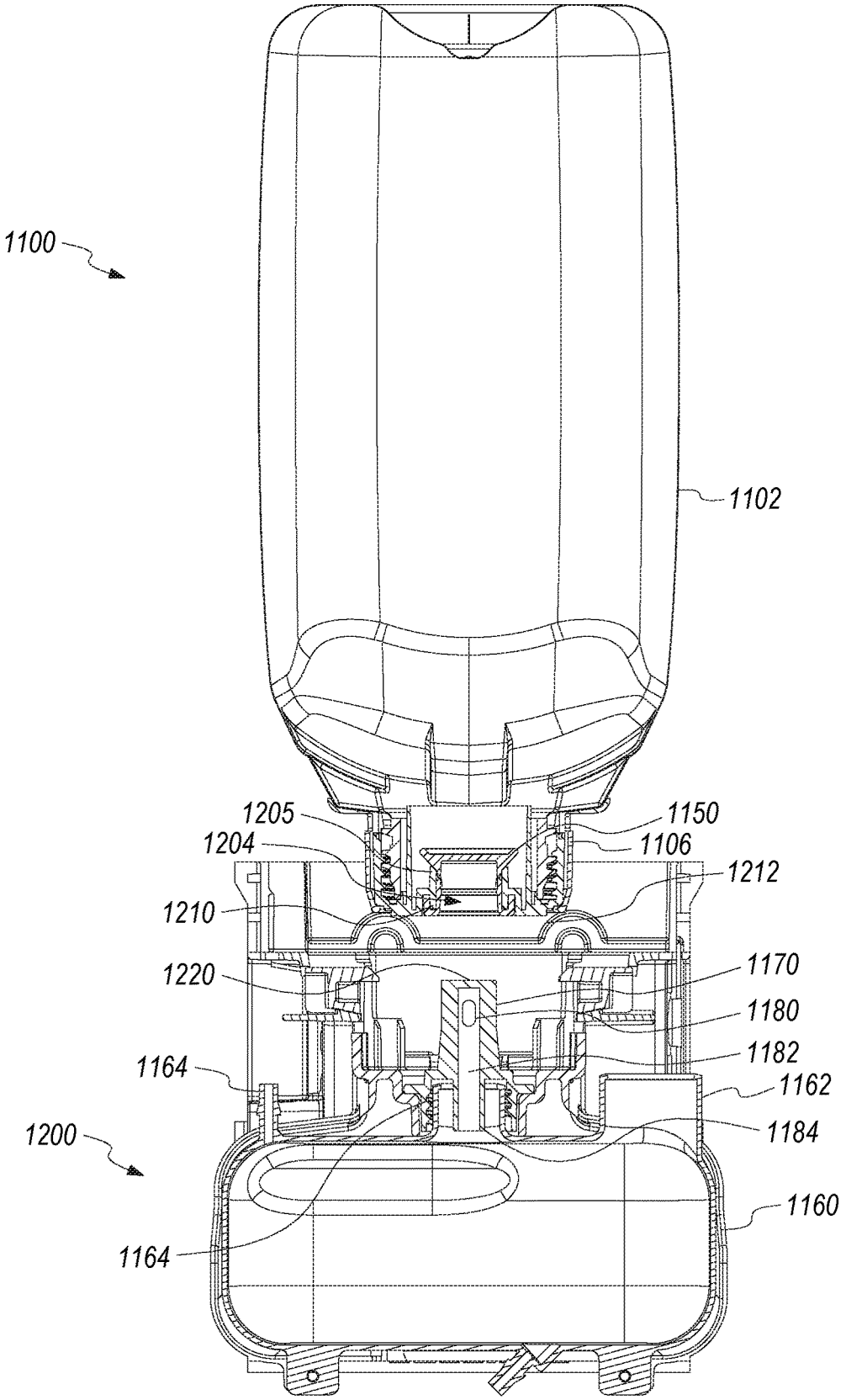
FIG. 12 is a cross-sectional view of the refill unit of FIG. 11 over a portion of a dispenser.
Figure 17:
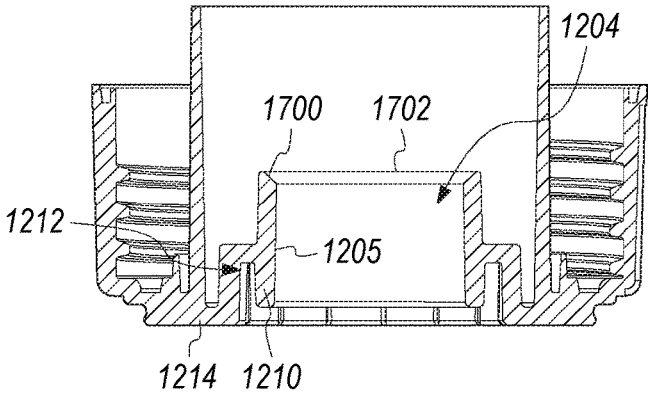
FIG. 17 is a cross-section of a closure.

Closure 1106 includes a cylindrical opening 1204 (FIG. 17 is a larger view of the closure 1106). Opening 1204 is formed by cylindrical projection 1205 (FIG. 12). Cylindrical projection 1205 has a lower wall portion 1210. A valve retention channel 1212 is located in the closure 1206 around the lower wall portion 1210 of cylindrical projection 1205. Located at the top of cylindrical projection 1205 is a valve seat 1700. Valve seat 1700 is an angled surface. In some instances, the angled surface may be between 0 degrees to 80 degrees. In some instances, the angled surface may be between 20 degrees to 70 degrees. In some instances, the angled surface may be between 30 degrees to 60 degrees. In some instances, the angled surface may be between 40 degrees to 50 degrees. In some instances, the angled surface may be about 45 degrees. Cylindrical projection 1205 has an upper surface 1702. The closure 1106 is shown in the position that closure 1106 will be in when connected to a container 1102 and the refill unit 1100 is installed in a dispenser. Accordingly, references to top surface or bottom surface, is related to the position closure 1106 is shown in FIG. 17 and the position that closure 1106 is when it is in a dispenser. Closure 1106 has a bottom surface 1214.

The stretch valve 1150 is secured to closure 1106 as described in more detail below. The stretch valves disclosed herein may be over molded to the closures, rather than attaching the stretch valves to the closures.

Figure 13:
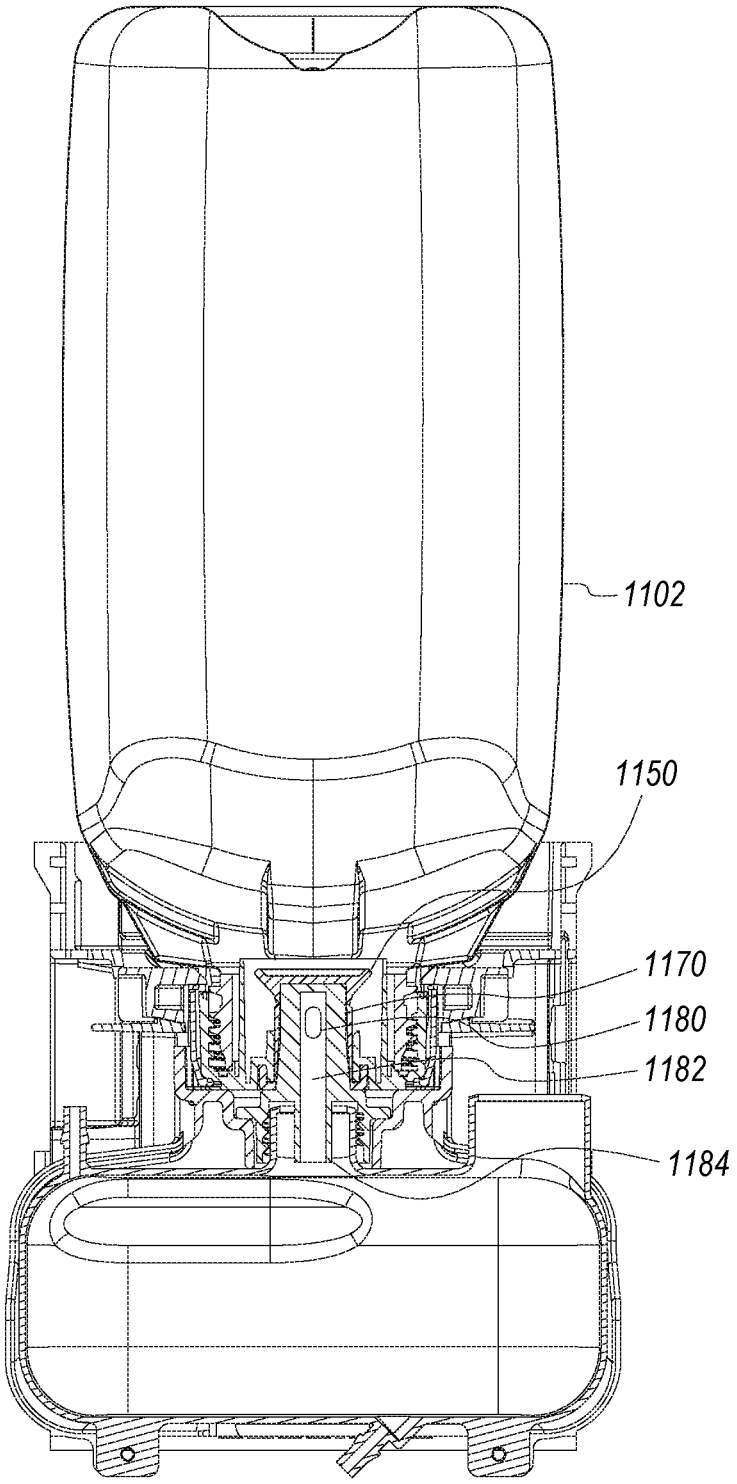
FIG. 13 is a cross-sectional view of the refill unit of FIG. 11 inserted into the portion of the dispenser of FIG. 12.

FIG. 12 is a cross-sectional view of a portion of a dispenser 1200 and refill unit 1102 removed from the dispenser 1200. Dispenser 1200 includes a reservoir 1160. Reservoir 1160 is a sealed reservoir and includes a neck 1202. Attached to neck 1202 is a valve post 1170. Valve post 1170 includes a valve contact surface 1220. Valve post 1170 includes one or more apertures 1180 therethrough providing a fluid flow path through valve post 1170 to an interior hollow passage 1182. A tube 1184 extends downward into reservoir 1160. Optionally, valve post 1173 includes one or more passages that allow air in reservoir 1160 to flow up into container 1102 as liquid is drawn out of container 1102. Optionally, apertures 1180 may be replaced or supplemented by castellations (not shown) at the top of the valve post 1173 providing a passage from the exterior of the valve post 1173 to the interior passage 1182. As described in more detail below, as refill unit 1102 is lowered into dispenser 1200, valve post 1170 contacts valve 1150 causing valve 1150 to stretch. When the valve 1150 is stretched, passageways in the valve 1150 allow fluid to flow therethrough. FIG. 13 illustrates the refill unit 1100 fully inserted in dispenser 1200 and stretch valve 1150 in its fully opened position.

Figure 14:
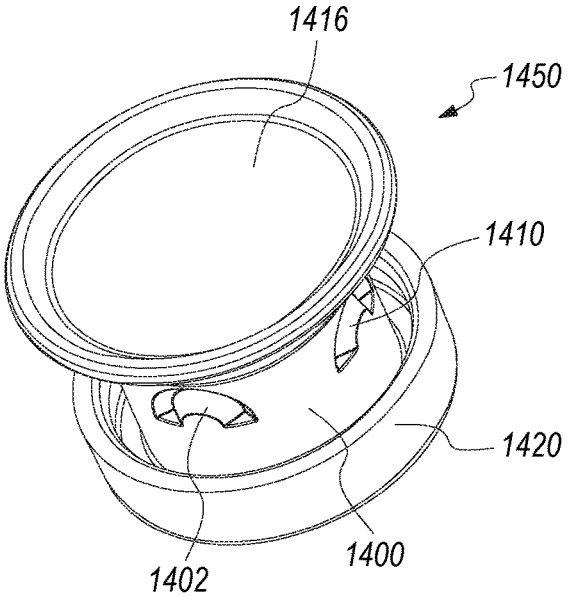
FIG. 14 is a prospective view of an exemplary stretch valve.
Figure 15:
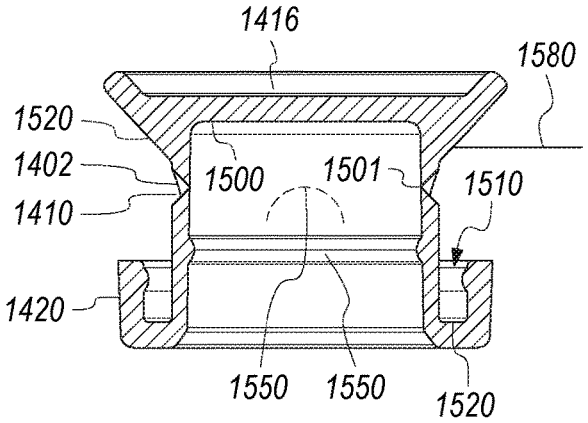
FIG. 15 is a cross-section of the exemplary stretch valve of FIG. 14.
Figure 16:
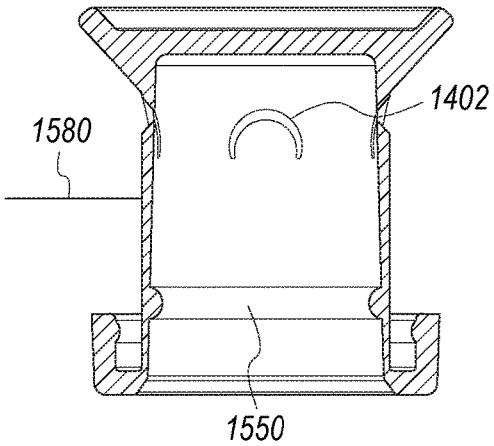
FIG. 16 is a cross-section of the exemplary stretch valve of FIG. 14 in a stretched or open position.

FIGS. 14 through 16 show an exemplary stretch valve 1150. Stretch valve 1150 is made of a resilient elastomeric material. Stretch valve 1150 may be made of, for example, one or more elastomers, rubber, silicone, urethane, thermoplastic elastomer, latex, polyisoprene. Accordingly, stretch valve 1150 may be stretched and will return to its original shape. Stretch valve 1150 includes a valve cap 1416, a valve cap lower surface 1500, a retention flange 1420, an annular channel 1520, a sealing bead 1550, one or more openings 1402 and a valve seal surface 1520.

Stretch valve 1150 is a normally closed valve. FIG. 15 illustrates stretch valve 1150 in an unstretched position. The term "unstretched position" does not mean that the valve body is not under some tension. Indeed, preferably the valve body is under some tension when the stretch valve 1150 is secured to the closure 1106 and in the closed position so that a good seal is made between the valve seal 1520 and the valve seat 1700. The term unstretched position may be synonymous with the closed position.

When the stretch valve 1106 is secured to closure 1106 the valve cap 1406 is located above the top surface 1702 of valve seat 1700, retention flange 1420 is located in retention channel 1212, and lower cylindrical wall 1210 is located in the annular channel 1520 of stretch valve 1150. The valve seal 1520 is sealed against the valve seat 1700, and the stretch valve 1106 is secured to closure 1106.

In addition, the body 1400 of stretch valve 1150 is located on the interior of cylindrical wall 1205 when connected to closure 1106. In some instances, having the body 1400 of stretch valve 1150 on the interior of cylindrical wall 1205 prevents the valve from miss-seating and leaking.

When the stretch valve 1106 is in the unstretched or closed position, openings 1402 are located below the top surface 1702 of the cylindrical wall 1205 of the closure. Line 1580 indicates the location of the top surface 1702 of cylindrical wall when valve 1106 is in the closed position. In addition, valve seal 1520 is seated against valve seat 1700 and fluid is prevented from flowing out of the container 1102. In addition, if container 1102 is squeezed compressed during transport, storage, or installation, the increased pressure may cause the valve seal 1520 to seat harder against valve seat 1700 ensuring that the fluid cannot leak out of container 1102.

FIG. 16 illustrates stretch valve 1106 in a stretched or open position. In the stretched or open position, openings 1402 are located above the top surface 1702 cylindrical projection 1205. The stretched or open position occurs when the lower surface 1500 of the valve cap 1416 is contacted by the top surface 1220 of valve post 1170 and moved upward or inward to stretch valve 1106. Accordingly, fluid may flow through openings 1402, through apertures 1180 in valve post 1170, through passage 1182. In this manner, liquid may flow from container 1102 into reservoir 1106. In addition, in some systems, air can flow out of reservoir 1106 and into container 1102.

When the refill unit 1100 is inserted into the dispenser 1200, sealing bead 1550, which is located on the inside of valve body and seals against valve post 1700 to prevent any fluid from passing between the stretch valve 1106 and the outside of valve post 1700. Stretch valve 1106 may have more than one sealing bead 1550. Optionally, a sealing bead (not shown), such as, for example, an o-ring, may be located on the valve post 1700. It is preferable to have the sealing bead 1550 located on the valve body 1400 because the refill unit 1400 is removed and replaced with a new refill unit when the refill unit 1400 is empty. Accordingly, each time the refill unit is replaced, a new sealing bead 1550 is provided, thus, eliminating issues with a seal on the valve post 1700 wearing out and leaking. When the refill unit 1100 is lifted off of the valve post 1700, the stretch valve 1150 closes and prevents fluid from leaking out of the refill unit 1100. Optionally, valve post 1700 may be tapered (not shown). When valve post 1700 is tapered, the valve body may seal radially against the tapered outside surface of the valve post 1700 and a sealing bead 1550 may not be required.

The one or more openings 1402 have a crescent shape with a sloped surface 1410 that terminates proximate the inside wall 1502 of valve body 1402. This results in the one or more openings 1402 being sealed during the manufacturing and assembly process. In other words, the one or more openings 1402 are not openings when inserted in the closure 1106. The first time stretch valve 1150 is stretched or opened, the very thin piece of elastomeric material proximate the inner wall 1502, tears or breaks and the one or more openings allow fluid to flow therethrough. Forming the one or more openings 1402 as described above aids in manufacturing the stretch valve 1150. In addition, because there are no openings in the stretch valve 1150, until its first use, the possibility of the stretch valve 1150 leaking during shipping and handling is further reduce. In addition, the one or more openings 1402 may have a larger area opening on the exterior of the valve body 1400 and a smaller area opening on the interior of valve body 1400.

Figure 18:
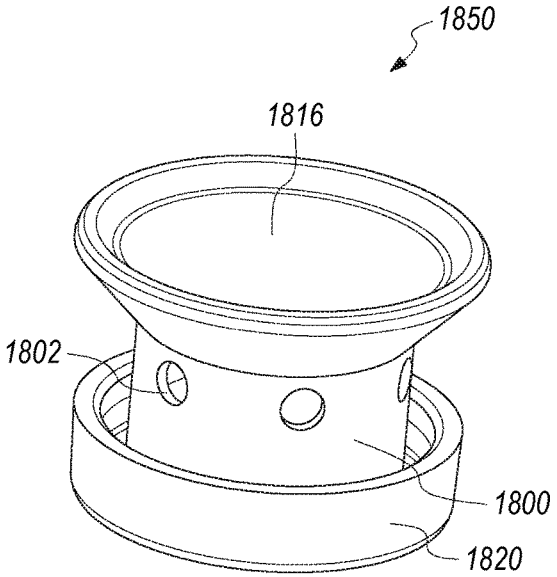
FIG. 18 is a prospective view of an exemplary stretch valve.
Figure 19:
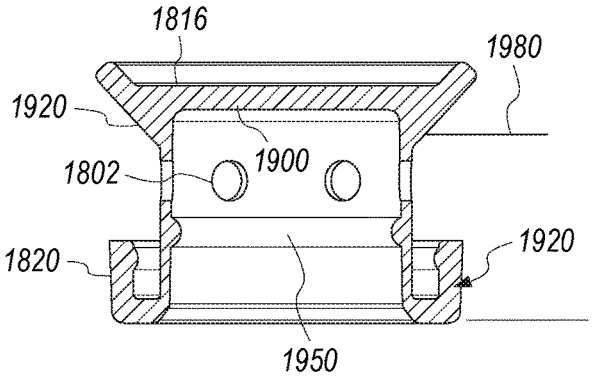
FIG. 19 is a cross-section of the exemplary stretch valve of FIG. 18.

FIGS. 18 through 19 show an exemplary stretch valve 1800. Stretch valve 1800 is made of a resilient elastomeric material. Stretch valve 1800 may be made of, for example, one or more elastomers, rubber, silicone, urethane, thermoplastic elastomer, latex, polyisoprene. Accordingly, stretch valve 1800 may be stretched and will return to its original shape. Stretch valve 1800 includes a valve cap 1816, a valve cap lower surface 1900, a retention flange 1820, an annular channel 1920, a sealing bead 1950, one or more openings 1802 and a valve seal surface 1920.

Stretch valve 1800 is a normally closed valve. FIG. 19 illustrates stretch valve 1800 in an unstretched position. The term "unstretched position" does not mean that the valve body is not under some tension. Indeed, preferably the valve body is under some tension when the stretch valve 1800 is secured to the closure 1106 and in the closed position so that a good seal is made between the valve seal 1920 and the valve seat 1700. The term unstretched position may be synonymous with the closed position.

When the stretch valve 1800 is secured to closure 1106 the valve cap 1806 is located above the top surface 1702 of valve seat 1700, retention flange 1820 is located in retention channel 1212, and lower cylindrical wall 1210 is located in the annular channel 1920 of stretch valve 1800. The valve seal 1920 is sealed against the valve seat 1700, and the stretch valve 1800 is secured to closure 1106.

In addition, the body 1800 of stretch valve 1800 is located on the interior of cylindrical wall 1205 when connected to closure 1106. In some instances, having the body 1400 of stretch valve 1150 on the interior of cylindrical wall 1205 prevents the valve from miss-seating and leaking.

When the stretch valve 1800 is in the unstretched or closed position, openings 1802 are located below the top surface 1802 of the cylindrical wall 1205 of the closure. Line 1880 indicates the location of the top surface 1702 of cylindrical wall when valve 1880. In addition, valve seal 1920 is seated against valve seat 1700 and fluid is prevented from flowing out of the container. In addition, if the container is squeezed compressed during transport, storage, or installation, the increased pressure may cause the valve seal 1920 to seat harder against valve seat 1700 ensuring that the fluid cannot leak out of container.

Figure 20:
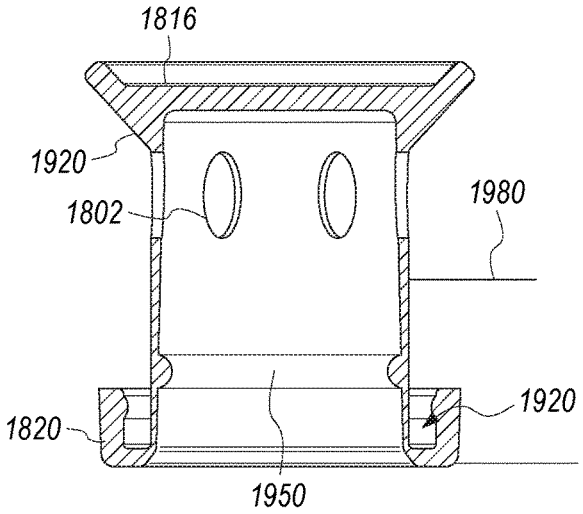
FIG. 20 is a cross-section of the exemplary stretch valve of FIG. 18 in a stretched position or open position.

FIG. 20 illustrates stretch valve 1800 in a stretched or open position. In the stretched or open position, openings 1802 are located above the top surface 1702 cylindrical projection 1205. The stretched or open position occurs when the lower surface 1900 of the valve cap 1816 is contacted by the top surface 1220 of valve post 1170 and moved upward or inward to stretch the stretch valve 1800. Accordingly, fluid may flow through openings 1802, through apertures 1180 in valve post 1170, through passage 1182. In this manner, liquid may flow from container 1102 into reservoir 1106. In addition, in some systems, air can flow out of reservoir 1106 and into container 1102.

When the refill unit 1100 is inserted into the dispenser 1200, sealing bead 1950, which is located on the inside of valve body and seals against valve post 1700 to prevent any fluid from passing between the stretch valve 1800 and the outside of valve post 1700. Stretch valve 1800 may have more than one sealing bead 1950. Optionally, a sealing bead (not shown), such as, for example, an o-ring, may be located on the valve post 1700. It is preferable to have the sealing bead 1950 located on the valve body 1800 because the refill unit 1100 is removed and replaced with a new refill unit when the refill unit 1100 is empty. Accordingly, each time the refill unit is replaced, a new sealing bead 1950 is provided, thus, eliminating issues with a seal on the valve post 1700 wearing out and leaking. When the refill unit 1100 is lifted off of the valve post 1700, the stretch valve 1150 closes and prevents fluid from leaking out of the refill unit 1100. When valve post 1700 is tapered, the valve body may seal radially against the tapered outside surface of the valve post 1700 and a sealing bead 1950 may not be required.

The one or more openings 1820 are circular openings. In some instances, the circular openings tend to elongate into oval openings when the valve is stretched. Other opening shapes are contemplated for the stretch valves disclosed herein. Such shapes may include square or rectangular shapes, oval shapes, and the like. In addition, the openings may be slits that are substantially closed when the stretch valve is closed and open when the stretch valve is opening. The one or more openings in the stretch valves are shown as being in a horizontal plane with respect to the valve body, however, some openings may be located above the height of other openings.

Figure 20A:
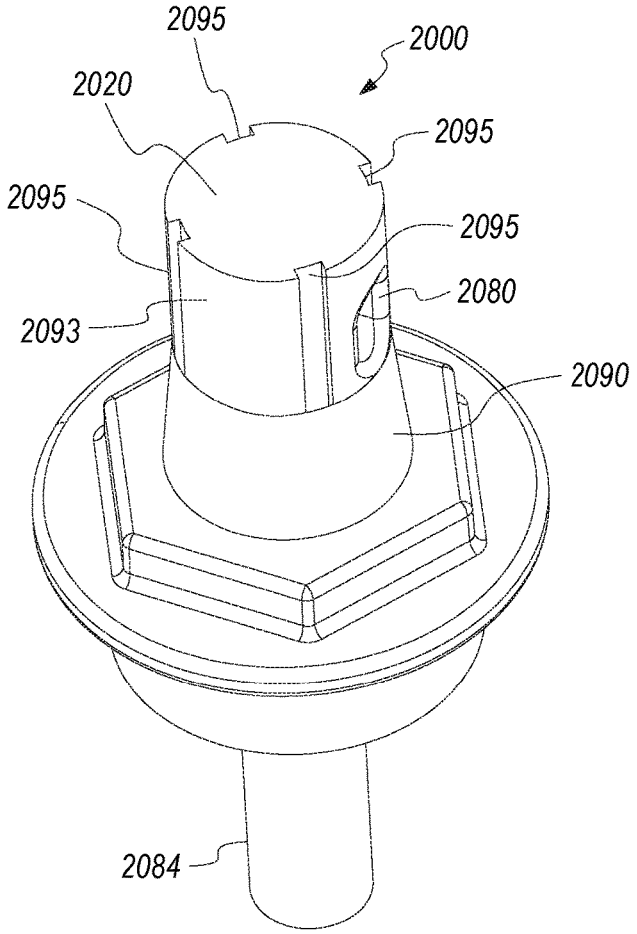
FIG. 20A is a prospective view of an exemplary post.
Figure 20B:
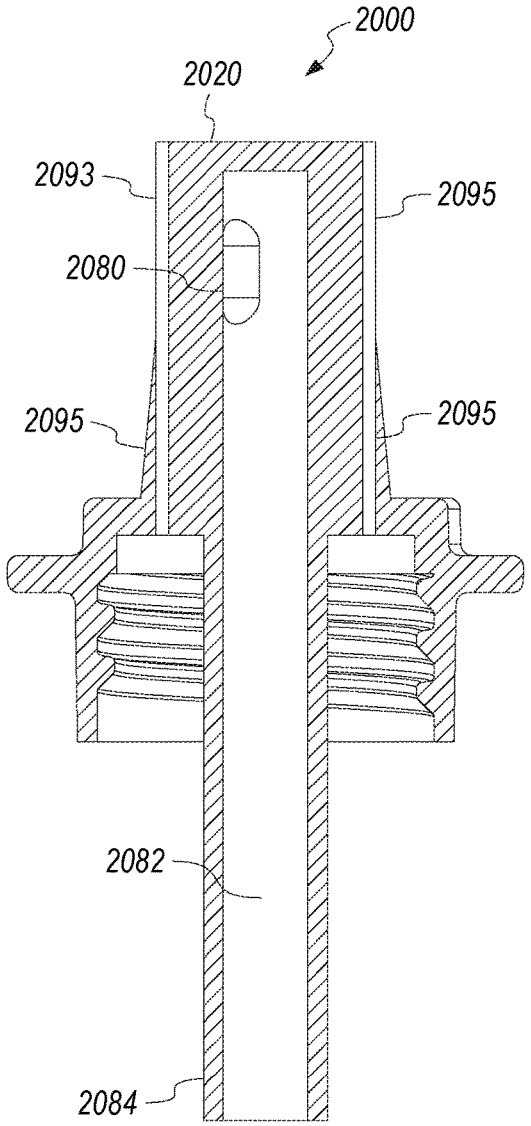
FIG. 20B is a cross-section of the exemplary post.

FIGS. 20A and 20B illustrate an exemplary valve post 2000. Valve post 2000 may be used in any of the dispensers disclosed herein. Valve post 2000 includes a valve contact surface 2020 and a valve post body 2093. Valve post body 2093 has aa tapered or flared position 2090. Valve post 2200 includes one or more apertures 2080 through the valve post body 2093 providing a fluid flow path through valve post 2000 to an interior hollow passage 2082. A tube 2084 extends downward into reservoir (not shown). Valve post 2000 includes one or more air passages or channels 2095 that allow air in the reservoir (not shown) to flow up into a container (not shown) as liquid is drawn out of the container. The one or more air passages or channels 2095 extend downward along the valve post body 2093 and become enclosed passageways as they pass through the tapered portion 2090. When a refill unit (not shown) is inserted over valve post 2000, the body of the stretch valve forms a seal around valve post 2000. Preferably the seal is located on the tapered section. A sealing bead on the stretch valve body (not shown) may or not be used to form the seal.

The one or more air passage 2095 do not need to extend along the entire valve post 2000. In addition, the one or more air passages 2095 are preferably sized so that the surface tension of the fluid in the container (not shown) prevents liquid from flowing down the one or more air passages 2095.

Figure 21:
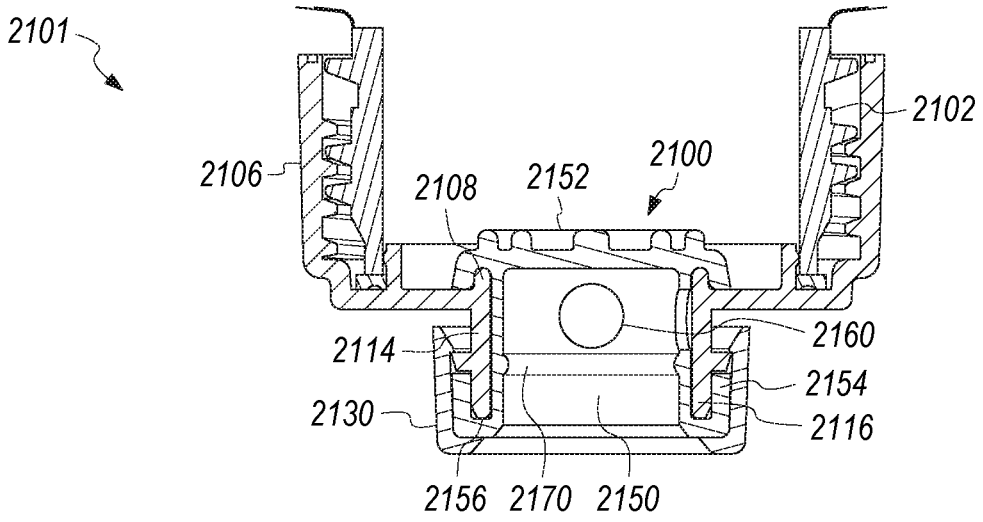
FIG. 21 is a cross-section of the exemplary stretch valve.
Figure 22:
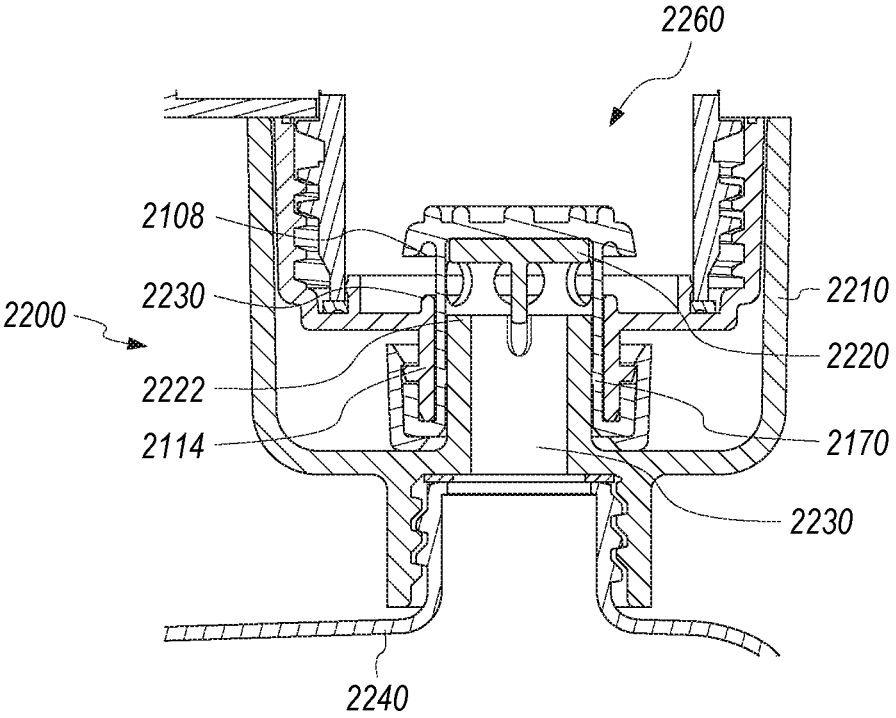
FIG. 22 is a cross-section of the exemplary stretch valve of FIG. 21 in a stretched position or open position.

FIGS. 21 and 22 illustrate another exemplary stretch valve 2100 in a portion of a refill unit 2101. Refill unit 2101 has a closure 2106 secured thereto. Closure 2160 includes a cylindrical wall 2114. The top of cylindrical wall 2114 forms a valve seat, and the bottom of cylindrical wall 2114 is received in annular channel 1520 for securing stretch valve 2100 to the closure.

Stretch valve 2100, which is show in its unstretched or open position, includes a valve body 2150, a retention flange 2154, a lower annular channel 2116, a valve sealing surface 2108, a valve cap 2152, one or more openings 2160 and a sealing bead 2170. Stretch valve 2100 is made of a resilient elastomeric material. may Stretch valve 2100 may be made of, for example, one or more elastomers, rubber, silicone, urethane, thermoplastic elastomer, latex, polyisoprene.

An optional valve retaining cap 2130 may be used to better secure the stretch valve 2100 to closure 2106. The components of stretch valve 2100 that are similar to those described above and are not repeated herein but apply to this stretch valve as well.

FIG. 22 illustrates the refill unit 2101 inserted in a portion of dispenser 2200. Dispenser 2200 includes a receptacle 2210 and a valve post 2220. The valve post 2220 includes one or more openings 2222 from the outside of the valve post 2220 to an interior passageway 2230, which leads to the interior of a reservoir 2240. When the refill unit 2101 is inserted into the dispenser 220, the valve post 2220 engages the stretch valve 2100, lifting the valve seal 2108 off of the valve seat 2230 and the one or more openings 2160, or at least a portion of the one or more openings 2160 move above the top of cylindrical wall 2114 allowing fluid to flow between the interior of the container 2260 and the reservoir 2240. When the refill unit 2101 is lifted off of the valve post 2220, the stretch valve 2100 closes and prevents fluid from leaking out of the refill unit 2100.

Figure 23:
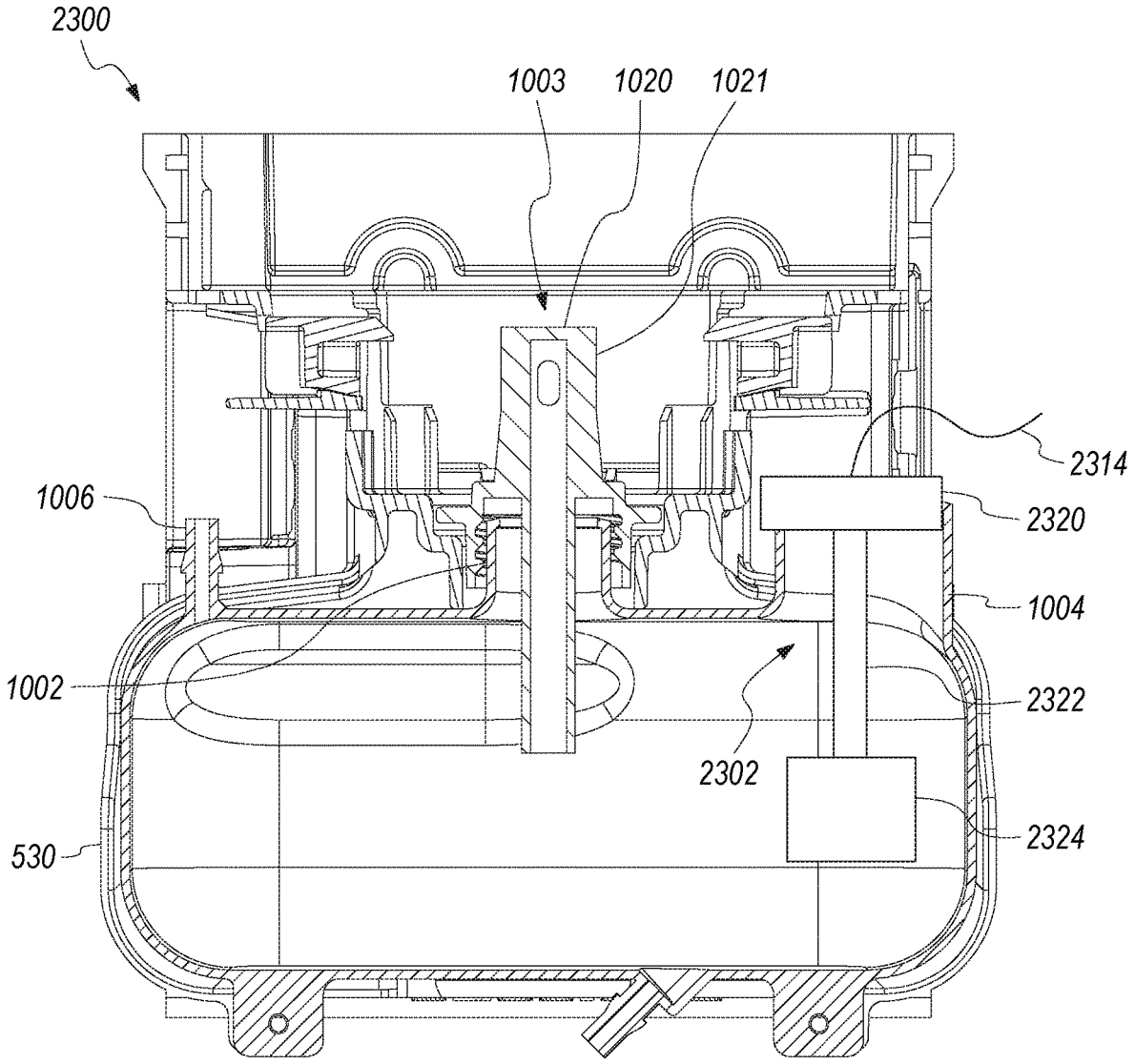
FIG. 23 is a cross-section of a portion of an exemplary dispenser having a level sensor on the reservoir.

FIG. 23 is a cross-section of a portion of a dispenser base 2300. Reservoir 530 is a sealed reservoir and includes a neck 1002. Attached to neck 1002 is a valve post 1003. Valve post 1003 engages a stretch valve (not shown) and opens the stretch valve (not shown) when refill unit (not shown) is inserted into dispenser base 2300. Valve post 1003 includes a valve contact surface 1020. Valve post 1003 includes one or more apertures 1023 from an outside surface 1021 of valve post 1003 to an interior hollow passage 1024. A tube 1025 extends downward into reservoir 530. Optionally, valve post 1003 includes one or more passages (shown in, e.g. FIGS. 20A and 20B) that allow air in reservoir 530 to flow up into a container as liquid is drawn out of the container. Reservoir 530 also includes a liquid outlet opening (not shown), which is in fluid communication with a pump (not shown), and a vent opening 1006 for connecting to a reservoir vet 530 as described herein.

Reservoir 530 includes opening 1004. A level sensor 2302 is secured to opening 1004. Level sensor 2302 may be any type of level sensor, such as, for example, a float, an optical sensor, a conductive sensor, or the like. The level sensor may be located within reservoir 530, outside of reservoir 530 or a combination thereof. The level sensor 2302 illustrated in FIG. 23 is a float sensor. Float sensor 2302 includes a retaining cap 2320, a stem 2322, a float 2324, and a cable 2314. Electronics required for the float to operate may be located in cap 2320, or remotely. The level sensor 2302 shown, has a float 2324 that floats on, or partially on, the top of liquid in reservoir 530 and moves up and down along stem 2322. When the level of liquid in the reservoir 530 drops below the bottom limit of travel for the float, a signal, sent along cable 2314, provides an indication that the level of liquid has reached a selected level.

Figure 24:
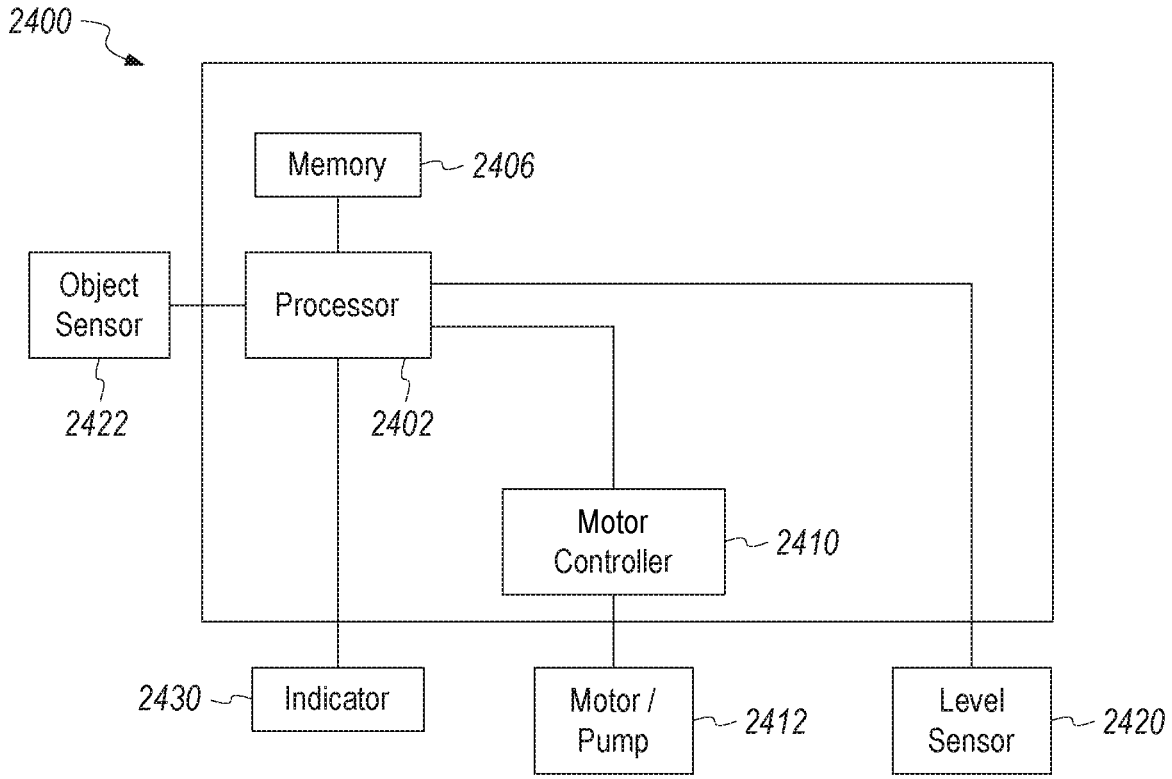
FIG. 24 is a simplified schematic diagram of an exemplary embodiment of control circuitry for a dispenser having a level sensor.

FIG. 24 is a simplified schematic design of a circuitry 2400 for a soap or sanitizer dispenser.

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions. The exemplary methodologies provide instructions for creating logic to control desired functions.

Values identified in the detailed description may be exemplary and may be different as needed for a particular dispenser and/or refill design. Accordingly, the inventive concepts disclosed and claimed herein are not limited to the particular values or ranges of values used to describe the embodiments disclosed herein.

Control circuitry 2400 includes a processor 2402, which is in circuit communication with memory 2406. Processor 2402 may be any type of processor, such as, for example, a microprocessor or microcontroller, discrete logic, such as an application specific integrated circuit (ASIC), other programmed logic device or the like. Depending on the need, memory 2406 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 2406 is separate from the processor 2402, and in some embodiments, the memory 2406 resides on or within processor 2402.

Processor 2402 is in circuit communication with motor controller 210, level sensor 23420, object sensor 2422 and optionally, indicator 2430. Processor 2402 is also in circuit communication with motor controller 2410. The motor/pump 2412 is in circuit communication with motor controller 2410. One of ordinary skill in the art in dispenser operation will be familiar with other required circuitry that is needed to perform the operations described herein and that circuitry may not be described in detail herein. In addition, the components may be located on one or more circuit boards, and/or selected components may be mounted separately. During operation object sensor 2422 monitors a detection zone and upon detecting an object, such as, for example, a hand, a signal is sent to processor 2402. Object sensor may be any type of object sensor, such as, for example, an infrared (IR) sensor, a capacitance sensor, an ultrasonic sensor, or the like. Processor 2402 checks level sensor 2420 to determine if the fluid level in the fluid reservoir is above a selected value. If it is, processor 2402 causes motor controller 2410 to operate motor/pump 2412 to dispense fluid. If the fluid level is not above the selected level, processor 2402 does not cause the motor controller 2410 to operate the motor/pump 2412. In addition, processor 2402 may provide a signal to indicator 2430. Indicator 2430 may be one or more of a light, and LED, a audible alarm, a communications signal that is transmitted wirelessly to a remote station or user, or the like.

Figure 25:
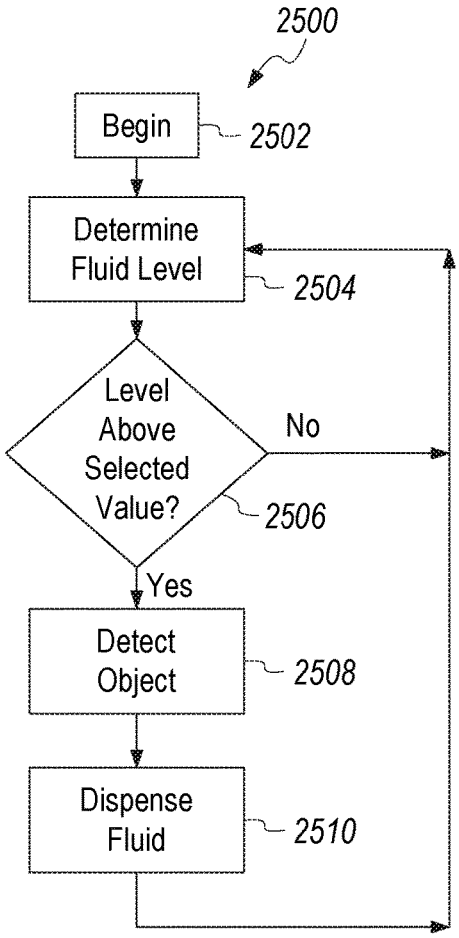
FIGS. 25 and 26 are exemplary logic diagrams for controlling a dispenser having level sensor in the reservoir for preventing loss of prime.
Figure 26:
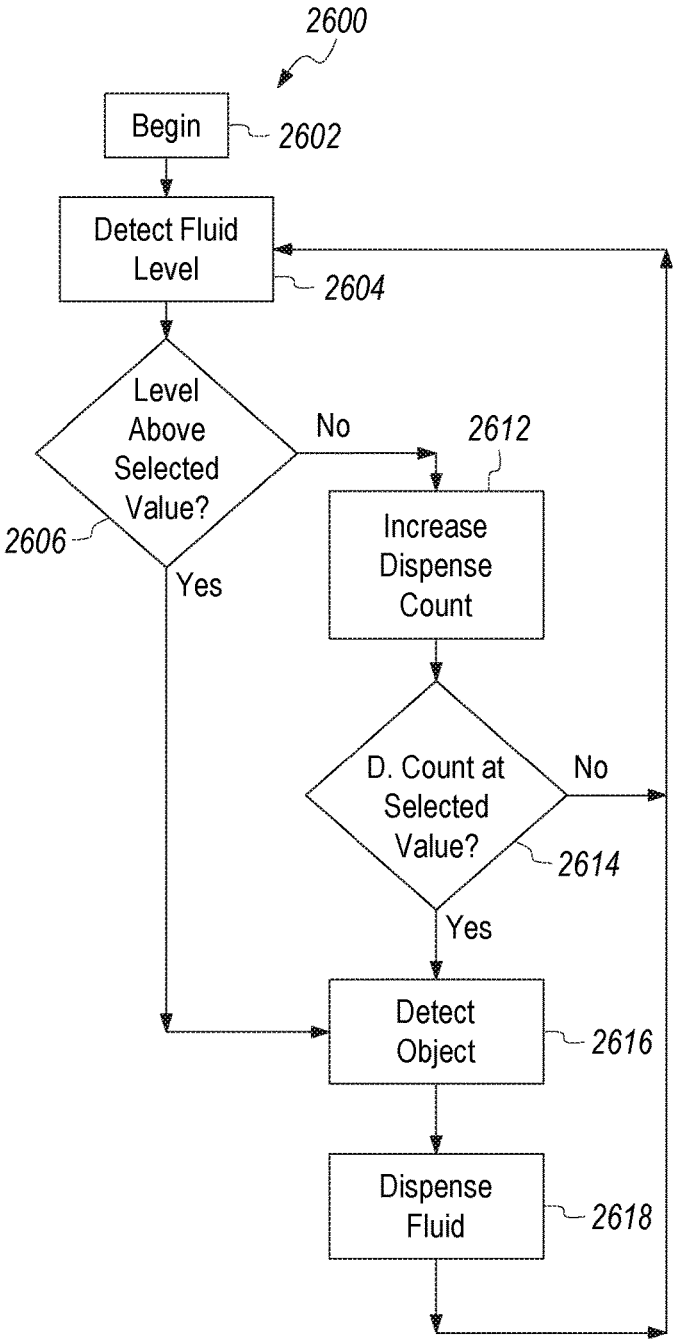

The processor 2410 is a special purpose processor and includes logic for controlling dispensing operations. FIGS. 25 and 26 are exemplary simplified logic diagrams or flow charts for converting the general purpose processor to a special purpose processor. Although the blocks or steps are illustrated in a certain order, other orders may be used. In addition, additional steps or blocks may be included. Further blocks or steps may be removed from the particular flow charts.

FIG. 25 illustrates an exemplary methodology 2500 for operating a dispenser to prevent the dispenser from losing prime. The exemplary methodology 2500 begins at block 2502. At block 2504 the level of fluid in the reservoir is determined. At block 2506 a determination is made as to whether the fluid level is above a selected value. If it is not, the exemplary methodology loops back to block 2504 until the reservoir is refilled. If at block 2506 the fluid level is above the selected value, the exemplary methodology flows to block 2508 until an object is detected. Once an object is detected, a dose of fluid is dispensed at block 2510.

Another exemplary methodology 2600 for operating a dispenser to prevent the dispenser from losing prime is shown in FIG. 26. The exemplary methodology 2600 begins at block 2602. At block 2604 the level of fluid in the reservoir is determined. At block 2606 a determination is made as to whether the fluid level is above a selected value. If it is not, the exemplary methodology flows to block 2612 where a dispense count is increased. (In some applications a dispense count may be decreased rather than increased). At block 2614, a determination is made as to whether the dispense count is at a selected value. If the dispense count has reached the selected value, the methodology flows to block 2604 until the reservoir is refilled. If the dispense count has not reached the selected value, the methodology flows to block 2610 to wait until an object is detected. Upon detection of an object, fluid is dispensed at block 2618. If at block 2606 the fluid level is above the selected value, the exemplary methodology flows to block 2616 until an object is detected. Once an object is detected, a dose of fluid is dispensed at block 2618.

Figure 27:
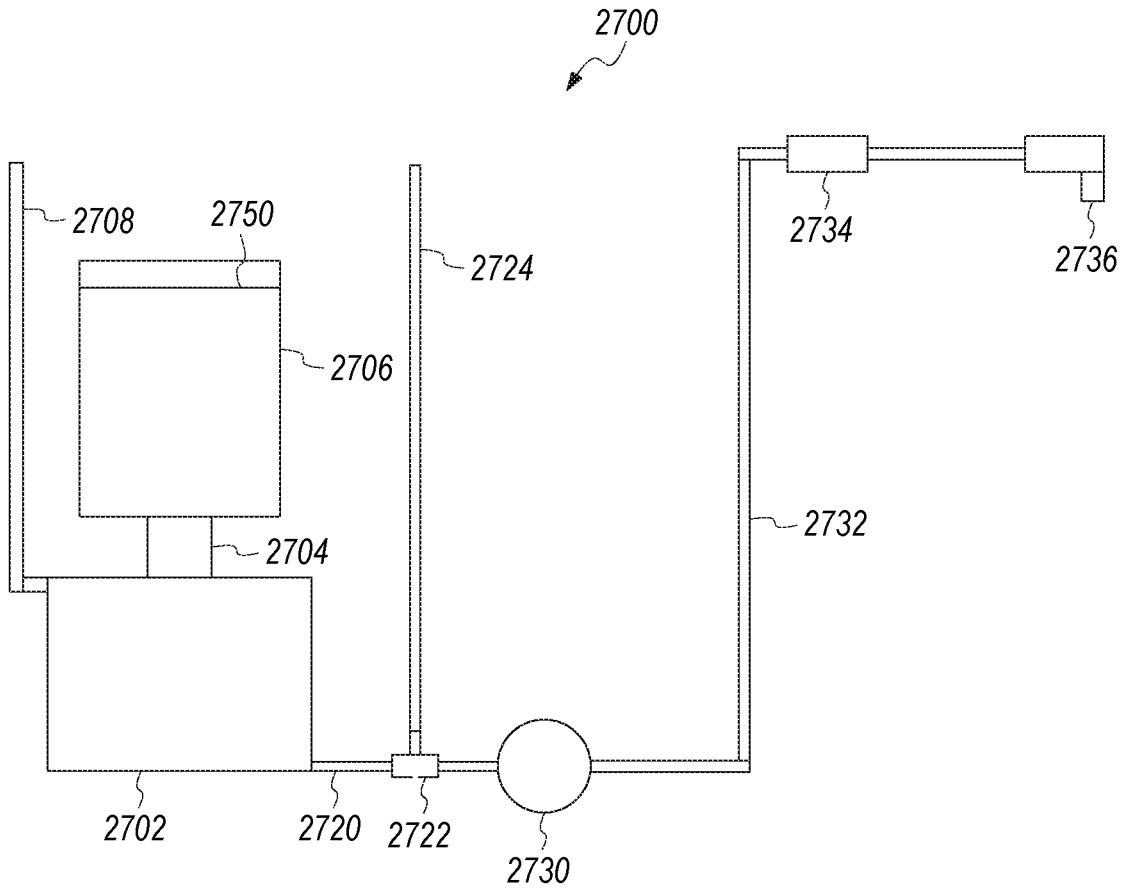
FIG. 27 is a simplified schematic diagram of another exemplary system for maintaining prime in a dispenser system.

FIG. 27 is another exemplary embodiment for maintaining prime in a dispenser system 2700. The dispenser system 2700 includes a permanent reservoir 2702, a removable and replaceable refill unit 2706. Refill unit 2706, like those described above, includes a container, a closure, and a valve. reservoir 2702 includes a valve post 2704 which opens the valve (not shown) and allows liquid to flow into reservoir 2702 and optionally allows air to flow from the reservoir into the container. A vent 2708 extends upward from the reservoir 2702. The top of the reservoir vent 2708 is located above a maximum fill point 2750 of the refill unit 2706. As liquid flows into reservoir 2702, air may flow out of reservoir 2702 through reservoir vent conduit 2708.

A liquid feed conduit 2720 extends from a liquid outlet of reservoir 2702 to a pump 2730. A tee 2722 is located in the liquid feed conduit 2720. A priming vent 2724 extends upward from the tee 2720 to a point above the maximum fill point 2750 of the refill unit 2706.

A pump outlet conduit 2732 extends from the pump 2730 to the outlet nozzle 2736. An optional one-way valve 2734 is located in the liquid outlet conduit 2732. Optionally, pump 2730 has both a liquid pump chamber (not shown) and one or more air pump chambers (not shown) and air is pumped separately from the liquid in an air output conduit (not shown) that extends from the pump 2730 to a mixing chamber (not shown) in outlet nozzle 2736.

If the reservoir 2702 runs out of liquid, the liquid feed conduit 2720 will fill with air as the pump 2730 operates. When the reservoir 2702 is filled with liquid, liquid flows into liquid feed conduit 2720. Air in liquid feed conduit 2720 flows up into prime vent conduit 2724. If prime vent conduit 2724 is close to pump 2730 most, if not all, of the air in liquid feed conduit 2720 will flow out of liquid feed conduit 2720 and into prime vent conduit 2724. Liquid will flow up prime vent conduit 2724, but not out of the dispenser system since conduit 2724 extends above the maximum fill line 2750 of the refill unit 2706.

If tee 2722 and prime vent 2724 are not in the system, when reservoir 2702 is refilled with liquid, pump 2730 may not be able to prime. This is because pump 2730 is required to pull all of the air through the liquid feed conduit 2740 and the head pressure in liquid outlet conduit 2732 may be too great for the pump 2730 to draw liquid through into liquid feed conduit 2720. This is particularly true if the outlet nozzle 2736 is located over a critical distance above pump 2730. It has been found that the critical distance is 4 inches in height. Over 4 inches in height may cause the dispenser system 2700 to fail to prime without the prime vent 2724.

Figure 28:
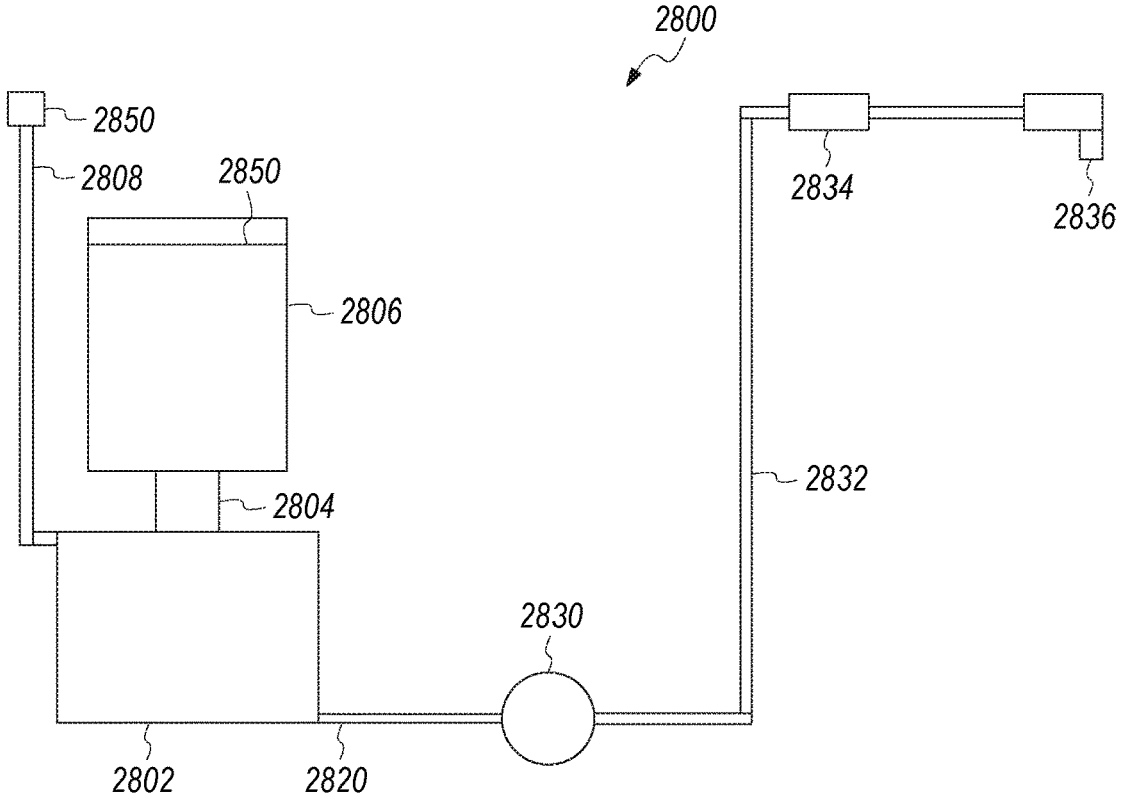
FIG. 28 is a simplified schematic diagram of an exemplary soap or sanitizer dispenser system 2800 having an anti-leak air vent and/or bubble trap.

FIG. 28 is a simplified schematic diagram of an exemplary soap or sanitizer dispenser system 2800 having an anti-leak air vent valve and bubble trap 2850. Although the anti-leak air vent valve and bubble trap 2850 is shown and described a s combined device, either the air vent valve or the bubble trap may be used separately. The dispenser system 2800 includes a permanent reservoir 2802, a removable and replaceable refill unit 2806. Refill unit 2806, like those described above, includes a container, a closure, and a valve. Reservoir 2802 includes a valve post 2804 which opens the valve (not shown) and allows liquid to flow into reservoir 2802 and optionally allows air to flow from the reservoir into the container. A vent conduit 2808 extends upward from the reservoir 2702. The top of the reservoir vent 2808 is located above a maximum fill point 2850 of the refill unit 2806.

Located proximate the top of the vent conduit 2808 is a vent valve, bubble trap 2850. The vent valve is preferably a normally open valve. Accordingly, as liquid flows into reservoir 2802, air may flow out of reservoir 2802 through reservoir vent conduit 2708 without having to open a valve. If liquid travels up vent conduit 2708 due to overfilling or a user squeezing the refill unit 2806 during installation, the vent valve closes and prevents liquid from flowing past the vent valve.

In addition, if bubbles form in the permanent reservoir 2802 while refilling the permanent reservoir 2802, the bubbles will flow up vent conduit 2708. The bubbles will flow past the vent valve and contact the bubble trap where the bubbles are broken down and prevented from flowing out of the vent tube. An exemplary vent valve and bubble trap 2850 is shown and described below in FIGS. 29 and 30.

A liquid feed conduit 2820 extends from a liquid outlet of reservoir 2802 to a pump 2830. A pump outlet conduit 2832 extends from the pump 2830 to the outlet nozzle 2836. An optional one-way valve 2834 is located in the liquid outlet conduit 2832. Optionally, pump 2830 has both a liquid pump chamber (not shown) and one or more air pump chambers (not shown) and air is pumped separately from the liquid in an air output conduit (not shown) that extends from the pump 2830 to a mixing chamber (not shown) in outlet nozzle 2836.

Figure 29:
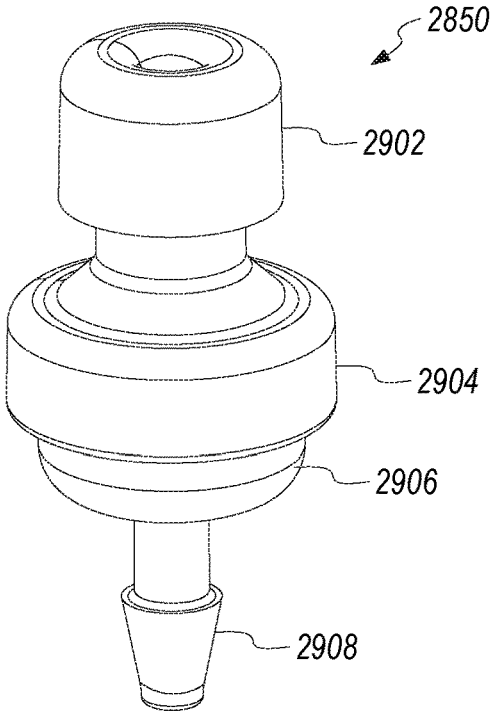
FIG. 29 is prospective view of an anti-leak air vents and bubble trap.

FIG. 29 is prospective view of an anti-leak air vent and bubble trap 2850. The an anti-leak air vent and bubble trap 2850 includes a lower valve housing 2906. Lower valve housing 2906 includes a barbed connector 2908 for connecting to a vent conduit. Anti-leak air vent and bubble trap 2850 has an upper valve housing 2904. Upper housing 2904 connects to lower valve housing 2906. The connection may be a snap fit connection as shown, a welded connection, an adhesive connection or the like. A bubble trap cap 2902 is connected to the upper valve housing 2904.

Figure 30:
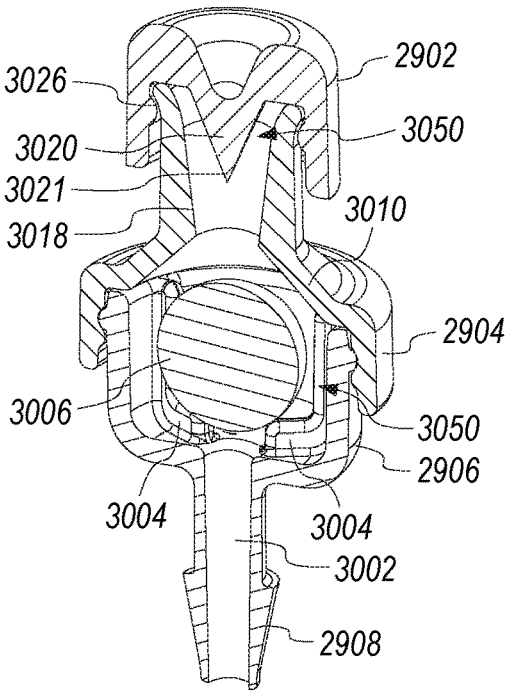
FIG. 30 is a cross-section of the anti-leak air vents and bubble trap of FIG. 29.

FIG. 30 is a cross-section of the anti-leak air vent and bubble trap 2850. Lower valve housing 2906 includes a passage 3002. Passage 3002 opens into a cavity 3050. A plurality of ribs 3004 extend along the bottom of cavity 3050. Optionally, the ribs 3004 extend up along the walls of cavity 3050. A ball 3006 is located within cavity 3050. Ball 3006 has a lower density than the soap or sanitizer and will float in soap or sanitizer. Ball 3006 may be a hollow ball, may be made of plastic, or the like. Upper housing 2904 includes a valve seat 3010. Valve seat 3010 is an angled surface. When ball 3006 moves up against valve seat 3010, it seals and stops fluid flow past the ball 3006 and valve seat 3010. The valve (ball 3006 and seat 310) is a normally open valve. Although a ball is shown and described, other valve arrangements may be used in the valve housing 2904, 2906. As one example, the valve may be a flap valve, wherein the flap valve is normally open and allows air to flow through but closes when liquid moves up against the flap valve.

Upper housing has an outward tapered portion 3018 located at its top. A bubble trap cap 2902 secured to upper housing 2904. The bubble trap cap 2902 may be secured to the upper housing 2904 by any method, such as, a snap-fit connection (as shown), a welded connection, a threaded connection, or the like. The connection between bubble trap cap 2902 and upper housing 3902 allows air to flow out of the top of upper housing 2904, past bubble trap cap 2902 and into the atmosphere.

Bubble trap cap 2902 has a downward extending conical projection 3020. The downward extending conical projection 3020 has a point 3021. As bubbles travel up and contact the conical projection 3020 the bubbles break down and turn back into a liquid and flow back down vent conduit (not shown). In addition, the smaller passageway 3050 causes the bubbles to breakdown.

A bubble trap (with a downward projection located in a pathway (the pathway may optionally be flared outward) with a similar configuration may be used and placed below the vent valve (a valve that closes due to contact with liquid). In addition, the bubble trap may be used without the vent valve. Also, the vent valve may be used without the bubble trap.

Figure 31:
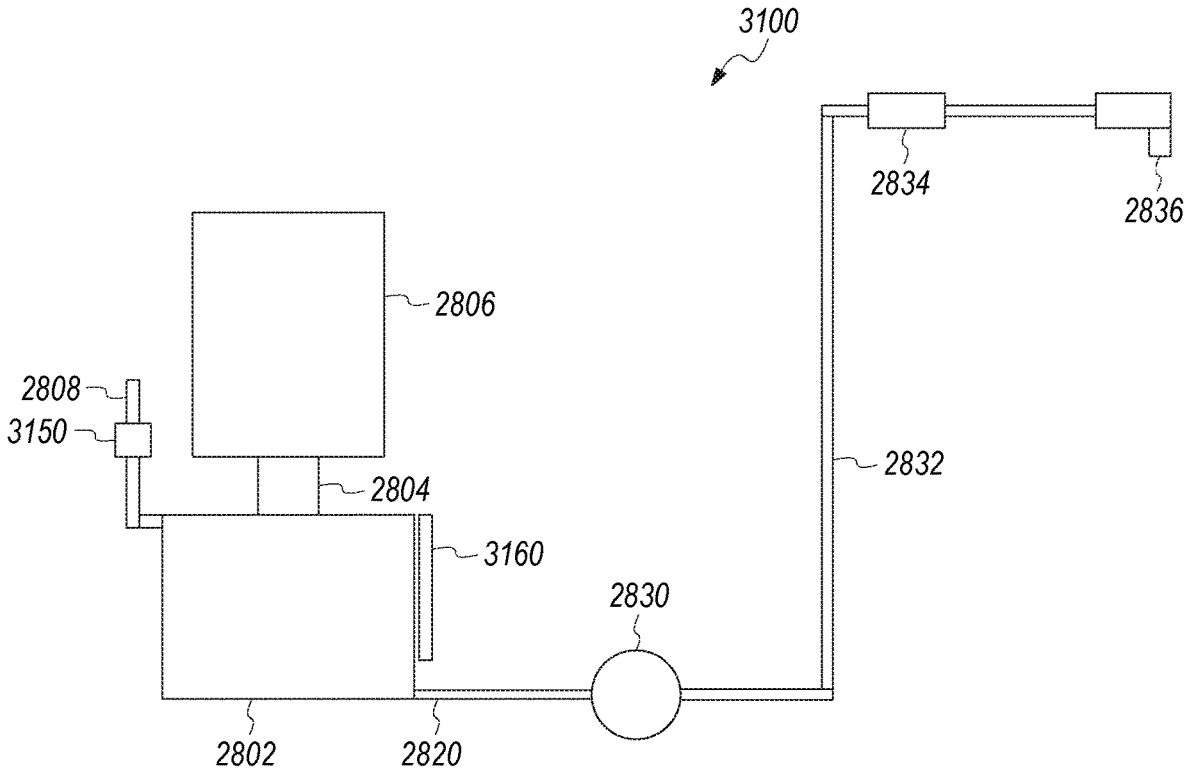
FIG. 31 is a simplified schematic diagram of an exemplary soap or sanitizer dispenser system 2800 having an electronic venting system.

FIG. 31 is a simplified schematic diagram of an exemplary soap or sanitizer dispenser system 3100 having an electronically controlled vent valve 3150. The components identified by like numbering as that of FIG. 28 are described above and not redescribed herein. In addition, system 3100 includes a level sensor 3160. Level sensor 3160 may be any type of level sensor, such as, for example, those shown and described above.

Electronically controlled valve 3150 may be, for example, a solenoid valve. Preferably, electronically controlled valve 3150 is configured so that it remains in position when power is taken off, i.e. the electronically controlled valve may be energized to open, and remains open when the signal is removed, and can be energized to close, and remains closed when the signal is removed.

During operation, if permanent reservoir 2802 is full or at a selected level, electronically controlled valve 3150 is closed. If permanent reservoir 2802 drops to a selected level, electronically controlled valve 3150 opens. A processor (not shown), memory (not shown), and other necessary electronic components that may be required to perform the intended operations are also included. In some embodiments, the electronically controlled valve 3150 remains closed even though the liquid level in the permanent reservoir 2802 is below the selected level, until the empty refill unit 2806 is removed from the dispenser system 3100.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A soap or sanitizing dispenser comprising:
a housing;
a permanent reservoir located within the housing;
a pump in fluid communication with the permanent reservoir;
a refill port;
wherein the refill port is configured to connect to a refill container;
a refill vent conduit extending upward from the permanent reservoir;
wherein the refill vent conduit extends above a maximum fill line of the refill container; and
a vent valve located proximate an upper end of the refill vent conduit.

2. The soap or sanitizer dispenser of claim 1 wherein the valve has an upper valve housing portion and the upper valve housing portion comprises a valve seat.

3. The soap or sanitizer dispenser of claim 1 further comprising a bubble trap.

4. The soap or sanitizer dispenser of claim 3 wherein the bubble trap has a downward extending conical projection.

5. The soap or sanitizer dispenser of claim 3 wherein the bubble trap is located above the valve seat.

6. The soap or sanitizer dispenser of claim 3 wherein the bubble trap has an outwardly tapered portion and a downward extending conical projection is located at least partially within the tapered portion.

7. The soap or sanitizer dispenser of claim 3 wherein the bubble trap is in a cap.

8. A soap or sanitizing dispenser comprising:
a housing;
a permanent reservoir located within the housing;
a pump in fluid communication with the permanent reservoir;
a refill port;
wherein the refill port is configured to connect to a refill container;
a refilling vent extending upward from the permanent reservoir;
wherein the refill vent conduit extends above a maximum fill line of the refill container;
a vent valve located proximate an upper end of the refill vent conduit; and
a bubble trap located proximate an upper end of the refill vent conduit.

9. The soap or sanitizer dispenser of claim 8 wherein the valve has an upper valve housing portion and the upper valve housing portion comprises a valve seat.

10. The soap or sanitizer dispenser of claim 9 wherein the bubble trap is located above the valve seat.

11. The soap or sanitizer dispenser of claim 8 wherein the bubble trap has a downward extending conical projection.

12. The soap or sanitizer dispenser of claim 8 wherein the bubble trap has an outwardly tapered portion and a downward extending conical projection is located at least partially within the tapered portion.

13. A soap or sanitizing dispenser comprising:
a housing;
a processor;
memory;
a permanent reservoir located within the housing;
a pump in fluid communication with the permanent reservoir;
a refill port;
wherein the refill port is configured to connect to a refill container;
a refilling vent conduit extending upward;
an electronically controlled vent valve located proximate an upper end of the refill vent conduit.

14. The soap or sanitizer dispenser of claim 13 further comprising a bubble trap.

15. The soap or sanitizer dispenser of claim 14 wherein the bubble trap has a downward extending conical projection.

16. The soap or sanitizer dispenser of claim 14 wherein the bubble trap is located above the electronically controlled valve.

17. The soap or sanitizer dispenser of claim 14 wherein the bubble trap has an outwardly tapered portion and a downward extending conical projection is located at least partially within the tapered portion.

18. The soap or sanitizer dispenser of claim 13 further comprising a level sensor for sensing the level of the permanent reservoir.

19. The soap or sanitizer dispenser of claim 18 wherein the processor opens the electronically controlled vent valve when the level of fluid is below a first level and closes the electronically controlled vent valve when the level of fluid is above a second level.

20. The soap or sanitizer dispenser of claim 19 wherein the first level and the second level are different levels.

* * * * *